US011176853B1

(12) United States Patent
Zachmann et al.

(10) Patent No.: US 11,176,853 B1
(45) Date of Patent: Nov. 16, 2021

(54) KINETIC SCULPTURE SYSTEM

(71) Applicants: Jeffrey C. Zachmann, Fergus Falls, MN (US); Carl J. Zachmann, Fergus Falls, MN (US)

(72) Inventors: Jeffrey C. Zachmann, Fergus Falls, MN (US); Carl J. Zachmann, Fergus Falls, MN (US)

( * ) Notice: Subject to any disclaimer, the term of this patent is extended or adjusted under 35 U.S.C. 154(b) by 0 days.

(21) Appl. No.: 17/220,568

(22) Filed: Apr. 1, 2021

(51) Int. Cl.
*G09F 19/08* (2006.01)

(52) U.S. Cl.
CPC ..... *G09F 19/08* (2013.01); *G09F 2019/085* (2013.01)

(58) Field of Classification Search
CPC ..... G09F 19/08; G09F 2019/085
See application file for complete search history.

(56) References Cited

U.S. PATENT DOCUMENTS 1,579,613 A * 4/1926 Holmes ..... A63H 33/40 40/413
1,593,085 A * 7/1926 Lang ..... A63H 33/40 40/413
3,220,253 A * 11/1965 Parker ..... G01P 5/06 73/170.07
3,290,817 A * 12/1966 Kravath ..... A63H 33/006 446/227
3,768,192 A * 10/1973 Caccamo ..... A01M 31/06 43/3
4,180,932 A * 1/1980 Millard ..... A63H 13/20 40/411
4,239,825 A * 12/1980 Kaulfuss ..... A63H 33/16 40/539
4,425,388 A * 1/1984 Oppenheimer, Jr. .. A63H 33/40 428/16
4,863,413 A * 9/1989 Schwarz ..... A63H 27/007 446/62
4,949,486 A * 8/1990 Belokin ..... A63H 13/20 40/414
D315,371 S * 3/1991 Van Risseghem ..... D11/141
5,073,137 A * 12/1991 Miller ..... A63H 27/00 446/61
5,146,702 A * 9/1992 Belokin, Jr. ..... G09F 19/08 40/414
5,483,764 A * 1/1996 Lin ..... G09F 19/08 40/411
D394,463 S * 5/1998 Filho ..... D10/59
(Continued)

*Primary Examiner* — Gary C Hoge
(74) *Attorney, Agent, or Firm* — Neustel Law Offices

(57) ABSTRACT

A kinetic sculpture system for powering one or more kinetic sculptures by an updraft to drive the one or more kinetic sculptures in a forward direction along a looped path. The kinetic sculpture system generally includes a pair of kinetic sculptures which are suspended over an updraft source by a hanging structure. Each of the kinetic sculptures includes a main body and a pair of wings pivotably attached to the main body. Each of the wings of each of the kinetic sculptures includes a front edge which is downwardly angled with respect to a rear edge such that the updraft from the updraft source catches upon the front edge to drive the kinetic sculptures forward along a looped path. In this manner, the kinetic sculptures may be driven along a fixed path around the updraft source without outside intervention.

20 Claims, 15 Drawing Sheets

(56) References Cited

U.S. PATENT DOCUMENTS 5,895,893 A * 4/1999 McMillian ..... G01G 1/02 177/126
5,896,687 A 4/1999 Lo
6,408,559 B2 * 6/2002 Mathews ..... A01M 31/06 43/3
D464,383 S * 10/2002 Weiser ..... D21/585
D464,685 S * 10/2002 Weiser ..... D21/585
D483,423 S * 12/2003 Weiser ..... D21/585
6,733,357 B1 * 5/2004 Weiser ..... A63H 33/40 446/217
D502,426 S * 3/2005 Weiser ..... D11/162
6,907,688 B2 * 6/2005 Brint ..... A01M 31/06 40/417
D539,363 S * 3/2007 Weiser ..... D11/162
7,536,823 B2 * 5/2009 Brint ..... A01M 31/06 40/417
2003/0106248 A1 6/2003 Chang
2003/0126774 A1 * 7/2003 Lim ..... G09F 19/08 40/412
2003/0230013 A1 12/2003 Chang
2003/0232299 A1 12/2003 Chang
2004/0086815 A1 5/2004 Hermanson
2004/0231205 A1 11/2004 Jen
2004/0237363 A1 * 12/2004 Weiser ..... G09F 19/08 40/427
2004/0265760 A1 12/2004 Swearingen
2005/0277076 A1 12/2005 Papai
2007/0025888 A1 2/2007 Gupte
2007/0289178 A1 * 12/2007 Lee ..... G09F 19/08 40/412
2008/0005946 A1 * 1/2008 Gary ..... G09F 1/08 40/615
2008/0207084 A1 * 8/2008 Schnuckle ..... A63H 13/02 446/268
2008/0289233 A1 * 11/2008 Lee ..... G09F 19/08 40/412

* cited by examiner

KINETIC SCULPTURE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a kinetic sculpture system for powering one or more kinetic sculptures by a heated updraft to drive the one or more kinetic sculptures along a looped path.

Related Art

Any discussion of the related art throughout the specification should in no way be considered as an admission that such related art is widely known or forms part of common general knowledge in the field.

Various types of kinetic sculptures are utilized in day-to-day life for a wide range of functions. In the past, such kinetic sculptures have typically been driven either manually (e.g., by hand) or by gravity (e.g., by pulling down on a cord). Further, such kinetic sculptures often do not accurately simulate the objects which they are meant to resemble.

For example, a common Christmas decoration involving angels circling a candle has no simulated movement of the angel's wings. Where the objects are simulated with motion of wings or the like, separate motions by the operator such as pulling on a string have been necessary.

SUMMARY

An example embodiment is directed to a kinetic sculpture system. The kinetic sculpture system includes a pair of kinetic sculptures which are suspended over an updraft source by a hanging structure. Each of the kinetic sculptures includes a main body and a pair of wings pivotably attached to the main body. Each of the wings of each of the kinetic sculptures includes a front edge which is downwardly angled with respect to a rear edge such that the updraft from the updraft source catches upon the front edge to drive the kinetic sculptures forward along a looped path. Additionally, the wings of each of the kinetic sculptures are balanced, with the weight of the outer portion of each wing being substantially similar to the weight of the combination of the inner portion of each wing and the main body. In this manner, the kinetic sculptures may be driven along a fixed path around the updraft source without outside intervention.

There has thus been outlined, rather broadly, some of the embodiments of the kinetic sculpture system in order that the detailed description thereof may be better understood, and in order that the present contribution to the art may be better appreciated. There are additional embodiments of the kinetic sculpture system that will be described hereinafter and that will form the subject matter of the claims appended hereto. In this respect, before explaining at least one embodiment of the kinetic sculpture system in detail, it is to be understood that the kinetic sculpture system is not limited in its application to the details of construction or to the arrangements of the components set forth in the following description or illustrated in the drawings. The kinetic sculpture system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
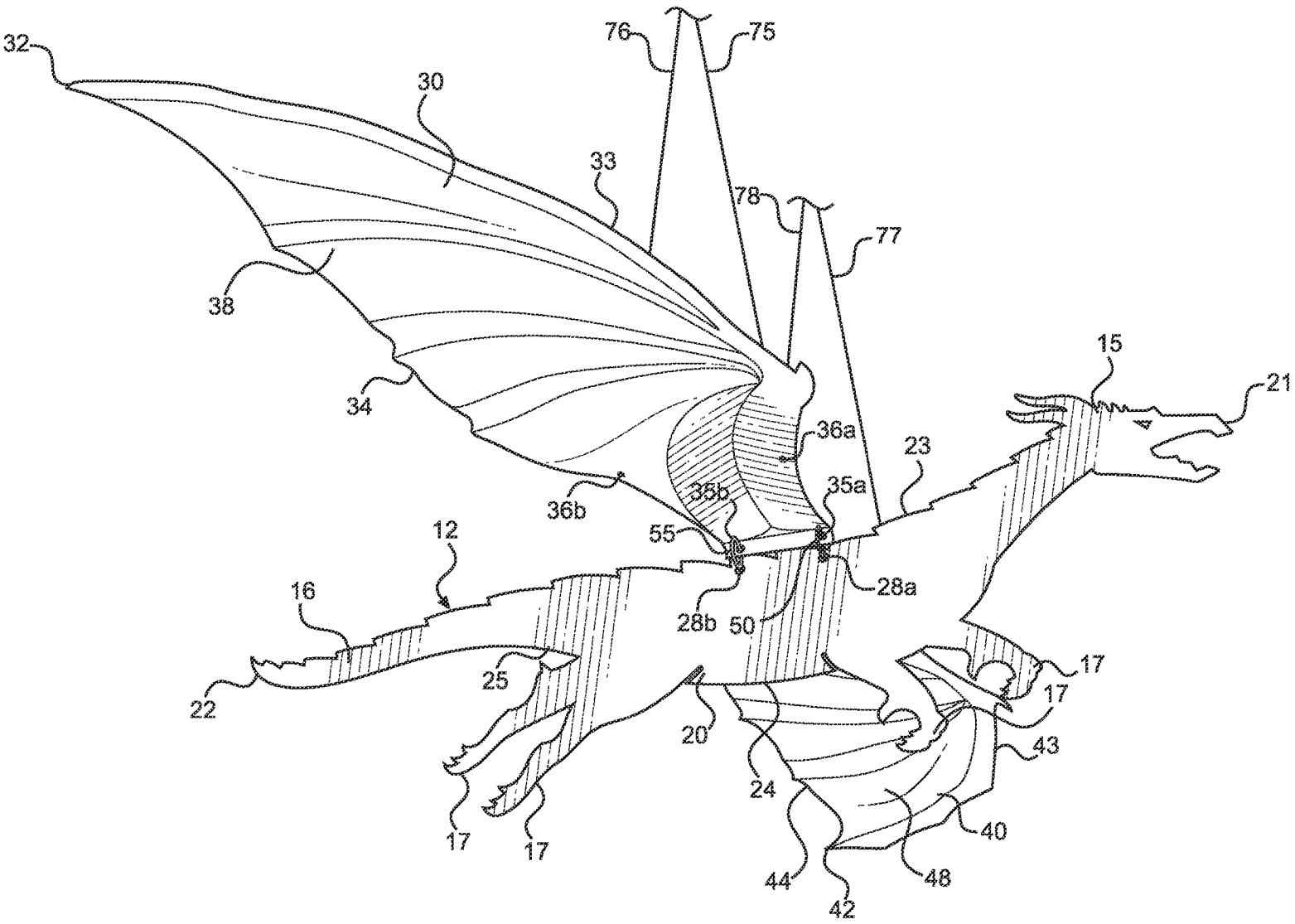
FIG. 1 is a perspective view of a kinetic sculpture in accordance with an example embodiment.

A. Overview.

An example kinetic sculpture 12 generally comprises a main body 20 including a first side 25 and a second side 26.

A first wing 30 is pivotably attached to the main body 20, with the first wing 30 extending outwardly from the first side 25 of the main body 20. The first wing 30 comprises a first front edge 33 and a first rear edge 34, with the first wing 30 being angled downwardly from the first rear edge 34 to the first front edge 33. A second wing 40 is pivotably attached to the main body 20, with the second wing 40 extending outwardly from the second side 26 of the main body 20.

The second wing 40 comprises a second front edge 43 and a second rear edge 44, with the second wing 40 being angled downwardly from the second rear edge 44 to the second front edge 43. The first front edge 33 of the first wing 30 and the second front edge 43 of the second wing 40 are each adapted to catch an updraft such that the first wing 30 and the second wing 40 drive the main body 20 in a forward direction. The updraft is an upward current of air that may be generated by various types of updraft sources such as, but not limited to, a heat source (e.g. fire) or other air movement devices that create a current of air (e.g. fan, blower). The updraft of air may be heated air or non-heated air.

The first wing 30 comprises a first inner portion 80 and a first outer portion 81, with the first outer portion 81 being weight balanced with the first inner portion 80 and the main body 20. The first outer portion 81 of the first wing 30 weights more than the first inner portion 80 of the first wing 30. The first outer portion 81 of the first wing 30 may be comprised of a first material and the first inner portion 80 of the first wing 30 may be comprised of a second material, with the first material weighing more than the second material.

The second wing 40 comprises a second inner portion 85 and a second outer portion 86, with the second outer portion 86 being weight balanced with the second inner portion 85 and the main body 20. The second outer portion 86 of the second wing 40 may be comprised of a first material and the second inner portion 85 of the second wing 40 may be comprised of a second material, with the first material weighing more than the second material.

The first front edge 33 of the first wing 30 is lower than the first rear edge 34 of the first wing 30 and the second front edge 43 of the second wing 40 is lower than the second rear edge 44 of the second wing 40. A first wing connector 50 may be attached to the main body 20, with the first and second wings 30, 40 being pivotably attached to the first wing connector 50. The first wing connector 50 may comprise a first loop 51 positioned on the first side 25 of the main body 20 and a second loop 52 positioned on the second side 26 of the main body 20. The first wing 30 may be pivotably attached to the first loop 51 and the second wing 40 may be pivotably attached to the second loop 52.

A second wing connector 55 may be attached to the main body 20, with the first and second wings 30, 40 being pivotably attached to the second wing connector 55. The second wing connector 55 may be comprised of a first loop 56 positioned on the first side 25 of the main body 20 and a second loop 57 positioned on the second side 26 of the main body 20. The first wing 30 may be pivotably attached to the first loop 56 and the second wing 40 may be pivotably attached to the second loop 57.

The main body 20 may be comprised of a dragon shape or various other shapes as discussed below. A first linkage 75 may be attached to the first wing 30 and a second linkage 78 may be attached to the second wing 40. The first linkage and the second linkage 75, 78 may each be comprised of a string.

In the figures, embodiments which utilize multiple kinetic sculptures 12, 12' differentiate between the first kinetic sculpture 12 and the second kinetic sculpture 12' by use of a prime symbol.

An exemplary embodiment of a kinetic sculpture system 10 may comprise a hanging structure 60 positioned over a heat source 19. A first kinetic sculpture 12 is suspended from the hanging structure 60, with the first kinetic sculpture 12 being comprised of a first main body 20 and a first pair of wings 30, 40 pivotably attached to the first main body 20. Each of the first pair of wings 30, 40 may comprise front edges 33, 43 which are angled downwardly with respect to each of their respective rear edges 34, 44. A second kinetic sculpture 12' is suspended from the hanging structure 60, with the second kinetic sculpture 12' being comprised of a second main body 20' and a second pair of wings 30', 40' pivotably attached to the second main body 20'. Each of the second pair of wings 30', 40' may comprise a second front edge 33', 43' which is angled downwardly with respect to each of their respective rear edges 34', 44'.

A convection current updraft from the heat source 19 is adapted to impact a lower side 38, 48, 38', 48' of each of the first and second pairs of wings 30, 40, 30', 40' to drive the first and second kinetic sculptures 12, 12' forward or backward along a looped path. The heat source 19 may be comprised of a fire. The hanging structure 60 may be comprised of a central portion 61, a first elongated member 62 extending in a first direction from the central portion 61, and a second elongated member 65 extending in a second, opposite direction from the central portion 61.

The first kinetic sculpture 12 may be suspended from the first elongated member 62 and the second kinetic sculpture 12' may be suspended from the second elongated member 65. A stand 90 including a vertical member 91 and a horizontal member 92 may be provided, with the vertical member 91 being anchored to a ground surface and the horizontal member 92 being positioned over the heat source 19. The hanging structure 60 may be suspended from the horizontal member 92. The first kinetic sculpture 12 may be comprised of a first shape and the second kinetic sculpture 12' may be comprised of a second shape that is different from the first shape.

B. Main Body.

As shown throughout the figures, the kinetic sculpture 12 generally comprises a main body 20 to which a pair of wings 30, 40 are pivotably attached. The main body 20 will generally comprise a flat member which has been shaped to resemble various types of objects or creatures. In the exemplary embodiment best shown in FIGS. 1, 6, 7, and 11-15, the main body 20 is configured to resemble the body of a dragon. It should be appreciated, however, that the main body 20 may comprise various other shapes to resemble various other objects or creatures, including but not limited to phoenixes, unicorns, various types of birds, airplanes, hovercrafts, rockets, spaceships, and various other objects or creatures. Thus, the shape and configuration of the main body 20 shown in the figures should not be construed as limiting.

As shown in FIG. 1, the main body 20 is generally vertically-oriented when in use. However, in some embodiments, the main body 20 may be horizontally- or diagonally-oriented. Further, while the figures illustrate that the main body 20 is substantially flat, it should be appreciated that, in some embodiments, the main body 20 may have a greater width than is shown in the figures.

In the exemplary figures, the main body 20 is shown as comprising a single, unitary member. However, in certain embodiments, the main body 20 may comprise discrete members which are interconnected together in various manners. Further, it should also be appreciated that the type of material utilized for the main body 20 may vary in different embodiments. For example and without limitation, the main body 20 may be comprised of various metals, metal alloys, plastics, paper-based materials such as cardboard, and the like.

As best shown in FIGS. 1-5, the main body 20 of the kinetic sculpture 12 will generally comprise a front end 21, a rear end 22, an upper end 23, a lower end 24, a first side 25, and a second side 26. The front end 21 of the main body 20 of the kinetic sculpture 12 may be shaped to resemble a head 15 of various objects or creatures. In the exemplary embodiment shown in the figures, the front end 21 of the main body 20 of the kinetic sculpture 12 is illustrated as resembling a dragon's head 15. It should be appreciated, however, that various embodiments may omit the use of a head 15, such as, for example, embodiments of the main body 20 which are configured to resemble various types of aircraft.

Continuing to reference FIGS. 1-5, the rear end 22 of the main body 20 of the kinetic sculpture 12 may be shaped to resemble a tail 16 of various objects or creatures. In the exemplary embodiment shown in the figures, the rear end 22 of the main body 20 of the kinetic sculpture 12 is illustrated as resembling a dragon's tail 16. It should be appreciated, however, that various embodiments may omit the use of a tail 16, such as, for example, embodiments of the main body 20 which are configured to resemble various objects or creatures which do not have a tail 16.

The lower end 24 of the main body 20 may include one or more legs 17 extending therefrom such as shown in FIG. 1. The number of legs 17 extending from the lower end 24 of the main body 20 may vary in different embodiments depending upon what type of object or creature the kinetic sculpture 12 is configured to resemble. In some embodiments, legs 17 may be omitted entirely, such as in embodiments configured to resemble various types of aircraft or the like. As an example, in some embodiments, the legs 17 may instead be configured to resemble landing great of an aircraft.

Figure 2:
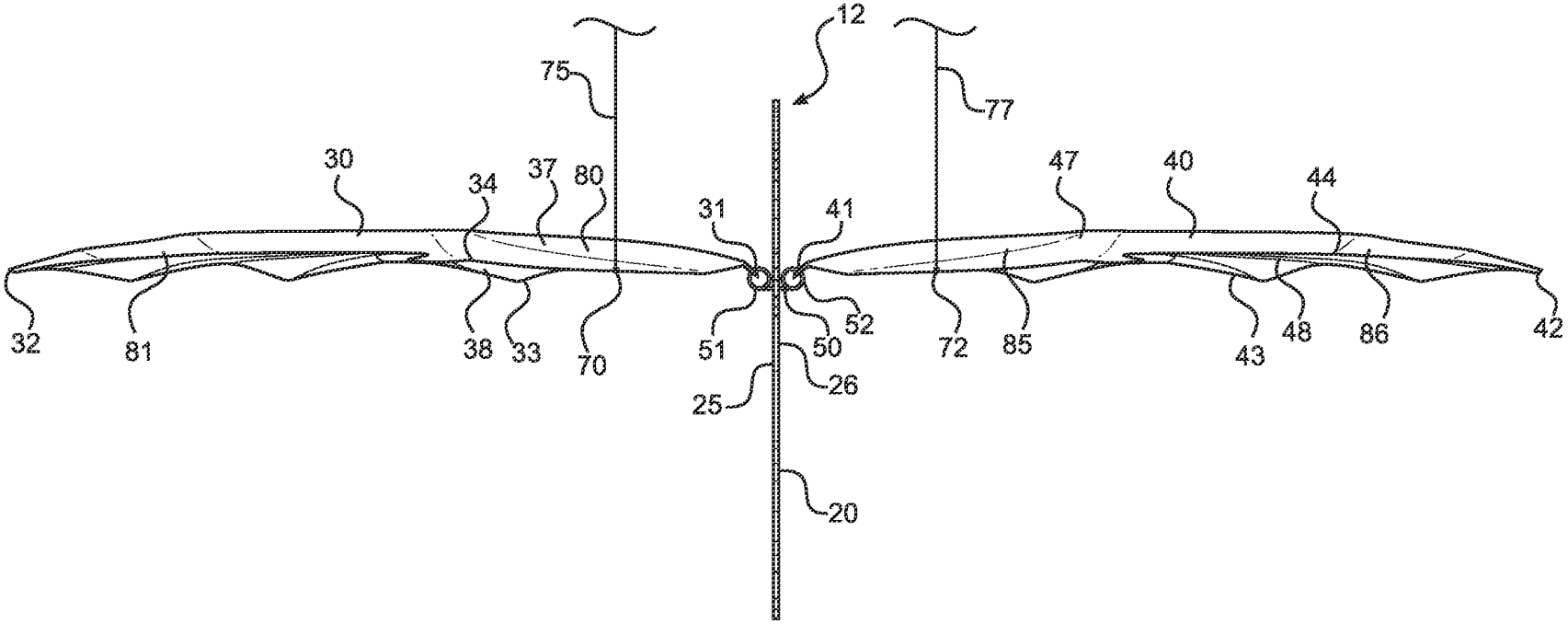
FIG. 2 is a frontal view of a kinetic sculpture in accordance with an example embodiment.
Figure 3:
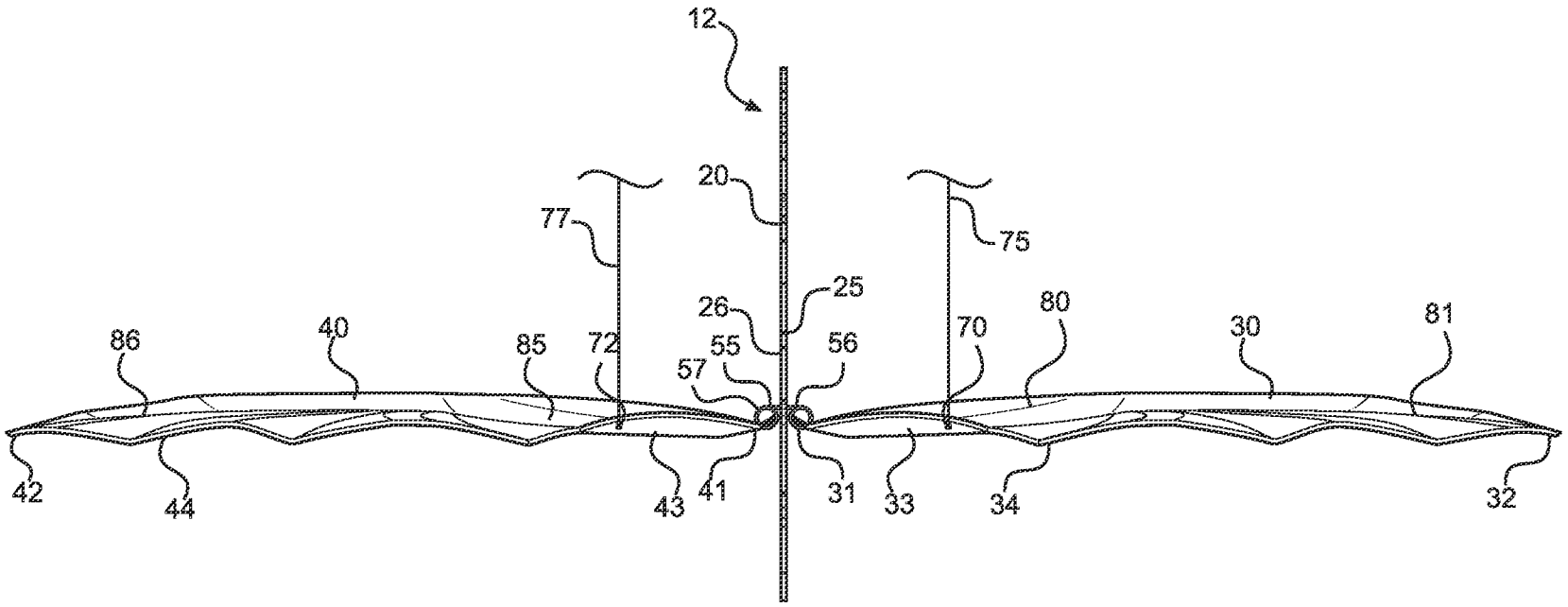
FIG. 3 is a rear view of a kinetic sculpture in accordance with an example embodiment.
Figure 6:
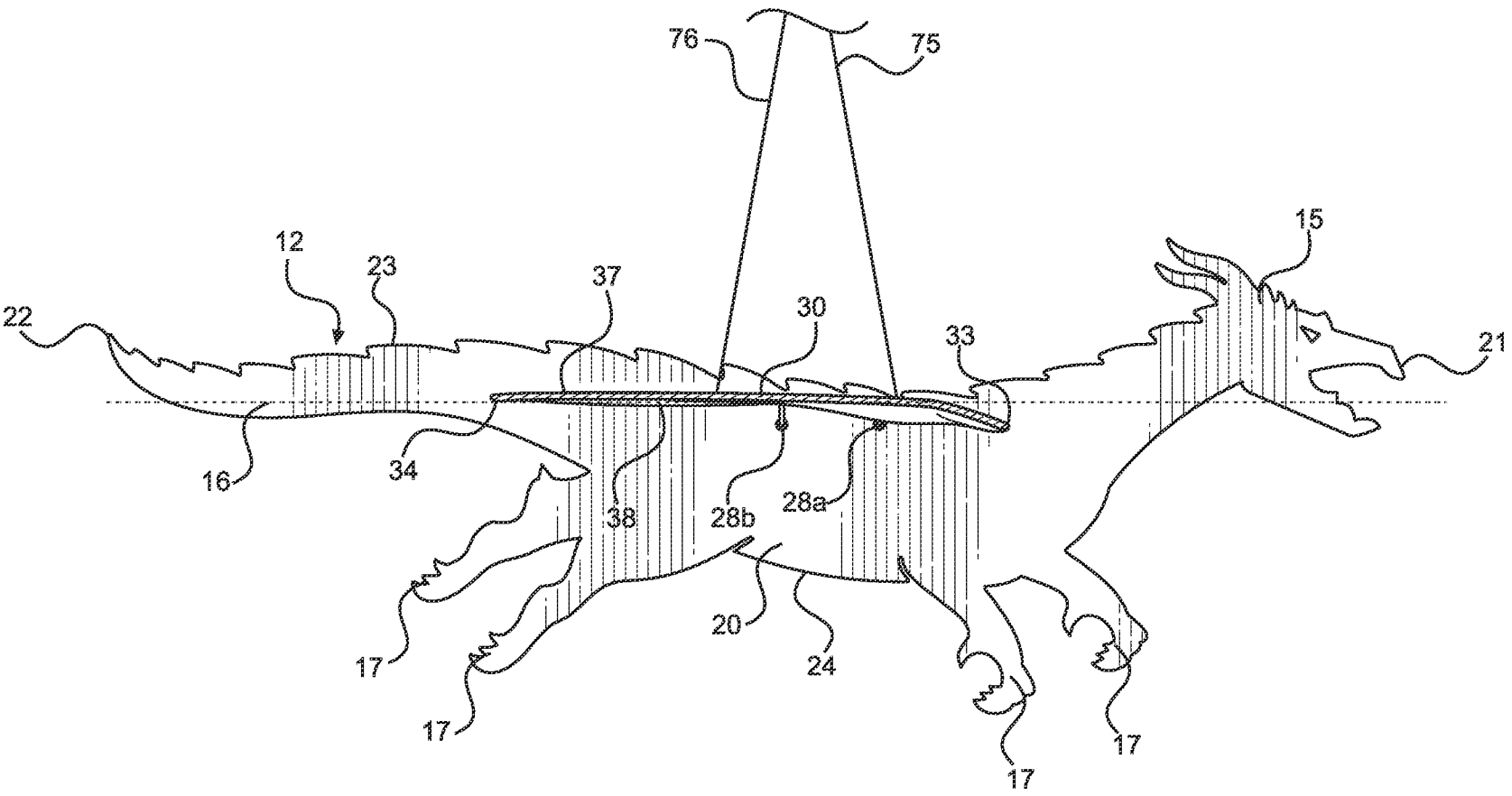
FIG. 6 is a side sectional view of a kinetic sculpture taken along line 6-6 of FIG. 5 in accordance with an example embodiment.

As best shown in FIGS. 1, 2, and 6, the upper end 23 of the main body 20 of the kinetic sculpture 12 will generally comprise one or more openings 28*a*, 28*b* through which one or more wing connectors 50, 55 may be engaged. In the exemplary embodiment shown in the figures, a first opening 28*a* and a second opening 28*b* are each positioned near the upper end 23 of the main body 20 of the kinetic sculpture 12, with the first opening 28*a* being closer to the front end 21 of the main body 20 and the second opening 28*b* being closer to the rear end 22 of the main body 20.

It should be appreciated that the positioning, spacing, size, orientation, and number of such openings 28*a*, 28*b* may vary in different embodiments. While the openings 28*a*, 28*b* will generally be positioned at the approximate mid-point of the main body 20 between its front end 21 and its rear end 22, various other positions could be utilized in certain embodiments. Further, the spacing between the openings 28*a*, 28*b* may vary in different embodiments, and thus the openings 28*a*, 28*b* could be either further away from each other or closer to each other than is shown in the exemplary embodiment of the figures.

While the figures illustrate the use of a pair of openings 28*a*, 28*b* comprised of a first opening 28*a* and a second opening 28*b*, it should be appreciated that more or less openings 28*a*, 28*b* may be utilized in different embodiments. The size of the openings 28*a*, 28*b* may also vary. Generally, the openings 28*a*, 28*b* may be sized to substantially match or may be larger than the size of the wing connectors 50, 55. As the size of the wing connectors 50, 55 may vary in different embodiments, the size of the openings 28*a*, 28*b* may also vary in different embodiments to suit differently-sized wing connectors 50, 55.

Finally, the orientation of the openings 28*a*, 28*b* may also vary in different embodiments. In the exemplary embodiment shown in FIGS. 1, 2, and 6, the openings 28*a*, 28*b* are linearly-aligned such that a straight, horizontal line may be drawn between the first opening 28*a* and the second opening 28*b* (i.e., the openings 28*a*, 28*b* are aligned along a straight line). In some embodiments, the openings 28*a*, 28*b* may not be linearly-aligned in such a manner. For example, the first opening 28*a* could be higher than the second opening 28*b*, or vice versa.

C. Wings.

As shown throughout the figures, the kinetic sculpture 12 will generally include a pair of wings 30, 40 which are pivotably attached to the main body 20 such that the wings 30, 40 may flap upwardly and downwardly. The shape, size, configuration, positioning, and orientation of the wings 30, 40 may vary in different embodiments as discussed herein. Additionally, the number of wings 30, 40 may also vary, with some embodiments including more than the two wings 30, 40 shown in the figures. In some embodiments, a single wing 30, 40 may be utilized, with the single wing 30, 40 being bifurcated by a hinge or other device which allows the two bifurcated portions of the single wing 30, 40 to flap independently of each other.

a. First Wing.

With reference to FIGS. 1-5, it can be seen that the first wing 30 generally comprises a first end 31 and a second end 32. The first end 31 of the first wing 30 is illustrated as being pivotably attached to the main body 20 of the kinetic sculpture 12. The positioning of the attachment point between the first wing 30 and the main body 20 may vary in different embodiments.

In the exemplary embodiment best shown in FIG. 1, it can be seen that the first wing 30 is pivotably attached near the upper end 23 of the main body 20 at the approximate mid-point between the front and rear ends 21, 22 of the main body 20. In some embodiments, the first wing 30 may instead be attached near the lower end 23 of the main body 20, or at any location between the upper and lower ends 23, 24 of the main body 20. Further, the first wing 30 may in some embodiments be attached closer to the front end 21 or the rear end 22 of the main body 20.

Figure 4:
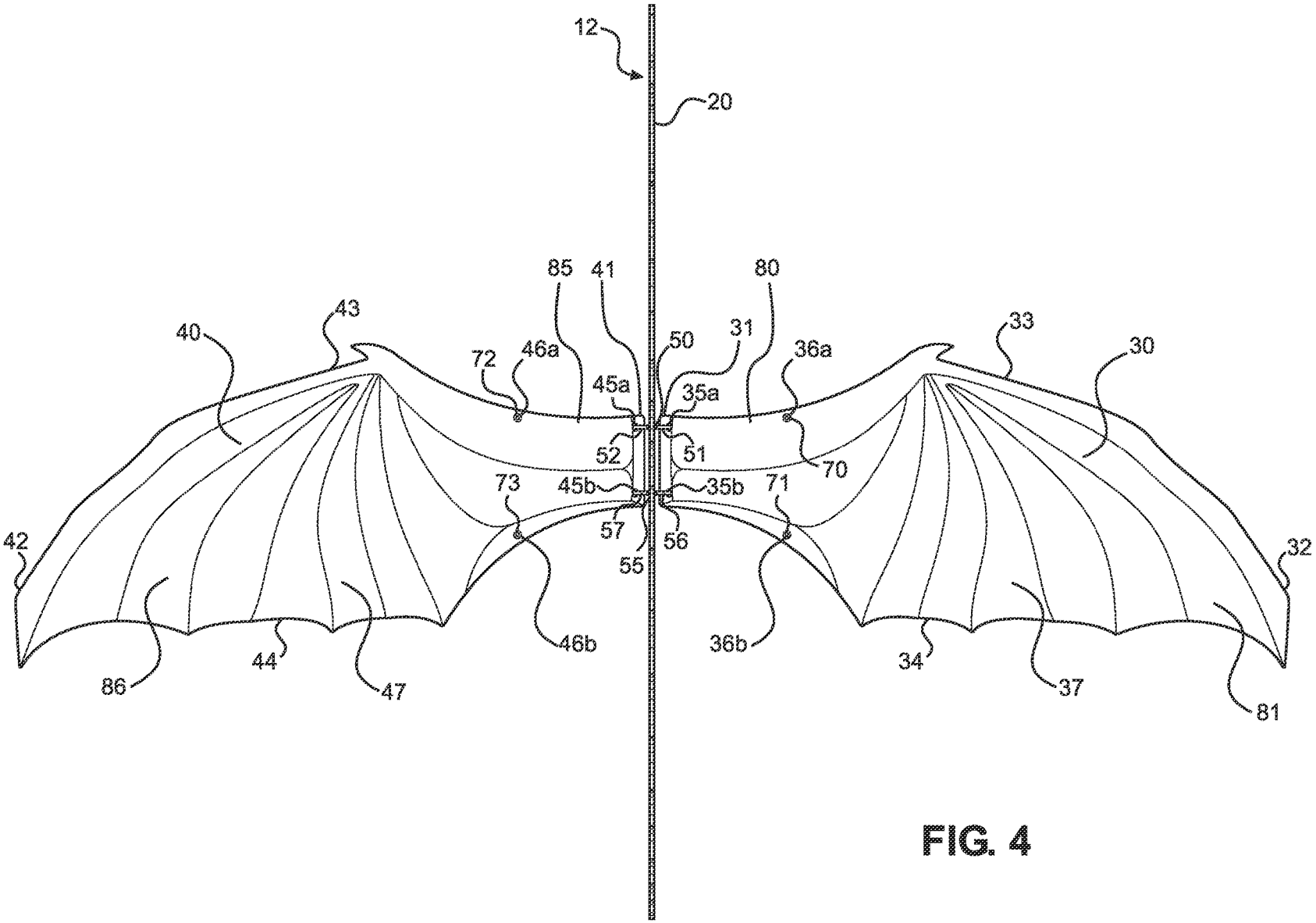
FIG. 4 is a top view of a kinetic sculpture in accordance with an example embodiment.

As shown in FIG. 4, the first wing 30 will generally comprise an inner portion 80 and an outer portion 81. The inner portion 80 may comprise the portion of the first wing 30 between the approximate mid-point of the first wing 30 between its first and second ends 31, 32 and the first end 31 of the first wing 30. The outer portion 81 may comprise the remaining portion of the first wing 30 between the approximate mid-point of the first wing 30 between its first and second ends 31, 32 and the second end 32 of the first wing 30. Thus, the inner portion 80 of the first wing 30 includes the first end 31 of the first wing 30 and the outer portion 81 of the first wing 30 includes the second end 32 of the first wing 30.

In some embodiments, the inner and outer portions 80, 81 of the first wing 30 may be defined by the attachment points of the linkages 75, 76 rather than being defined by the mid-point between the respective sides 31, 32 of the first wing 30. In such embodiments, the inner portion 80 of the first wing 30 is defined as the portion of the first wing 30 that is inset with respect to the attachment points of the linkages 75, 76 attached to the first wing 30 and the outer portion 81 of the first wing 30 is defined as the portion of the first wing 30 that is outset with respect to the attachment points of the linkages 75, 76 attached to the first wing 30.

Generally, the first wing 30 will be balanced such that the first wing 30 is adapted to catch airflow such as an updraft to drive the main body 20 of the kinetic sculpture 12 in a forward or backward direction. Put differently, the first wing 30 is balanced so the weight on the outer portion 81 of the first wing 30 offsets the weight of the main body 20 and the inner portion 80 of the first wing 30. This can be accomplished in a number of manners. As an example, the inner portion 80 of the first wing 30 may comprise a first material and the outer portion 81 of the first wing 30 may comprise a second material, with the materials being selected based on their weights to balance the first wing 30.

As a further example, the respective weights of the inner and outer portions 80, 81 of the first wing 30 may be balanced by the thickness of the respective portions 80, 81 of the first wing 30. Thus, the thickness of the outer portion 81 of the first wing 30 may be greater than the thickness of the inner portion 80 of the first wing 30 such that the weight of the outer portion 81 is balanced with the weights of both the inner portion 80 of the first wing 30 and the main body 20. In yet other embodiments, weights or the like may be added to either the inner or outer portion 80, 81 of the first wing 30 to balance the inner and outer portions 80, 81.

Figure 5:
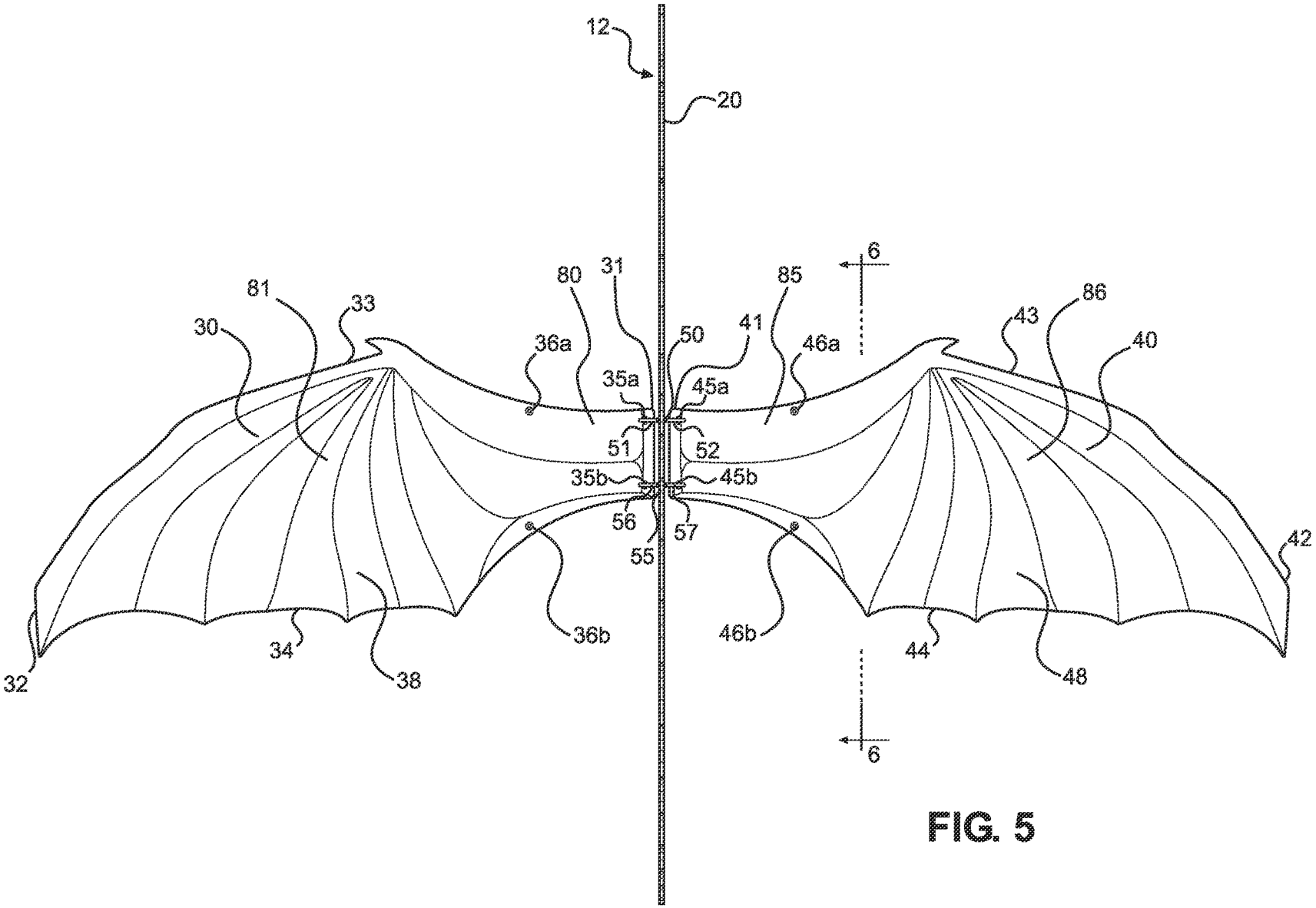
FIG. 5 is a bottom view of a kinetic sculpture in accordance with an example embodiment.

As shown in FIGS. 4 and 5, the first wing 30 generally comprises a front edge 33 and a rear edge 34. The front edge 33 of the first wing 30 faces towards the forward direction along which the kinetic sculpture 12 is driven, such as by heat convection. The rear edge 34 of the first wing 30 faces away from the forward direction (e.g., in the reverse direction) along which the kinetic sculpture 12 may be driven.

Figure 7:
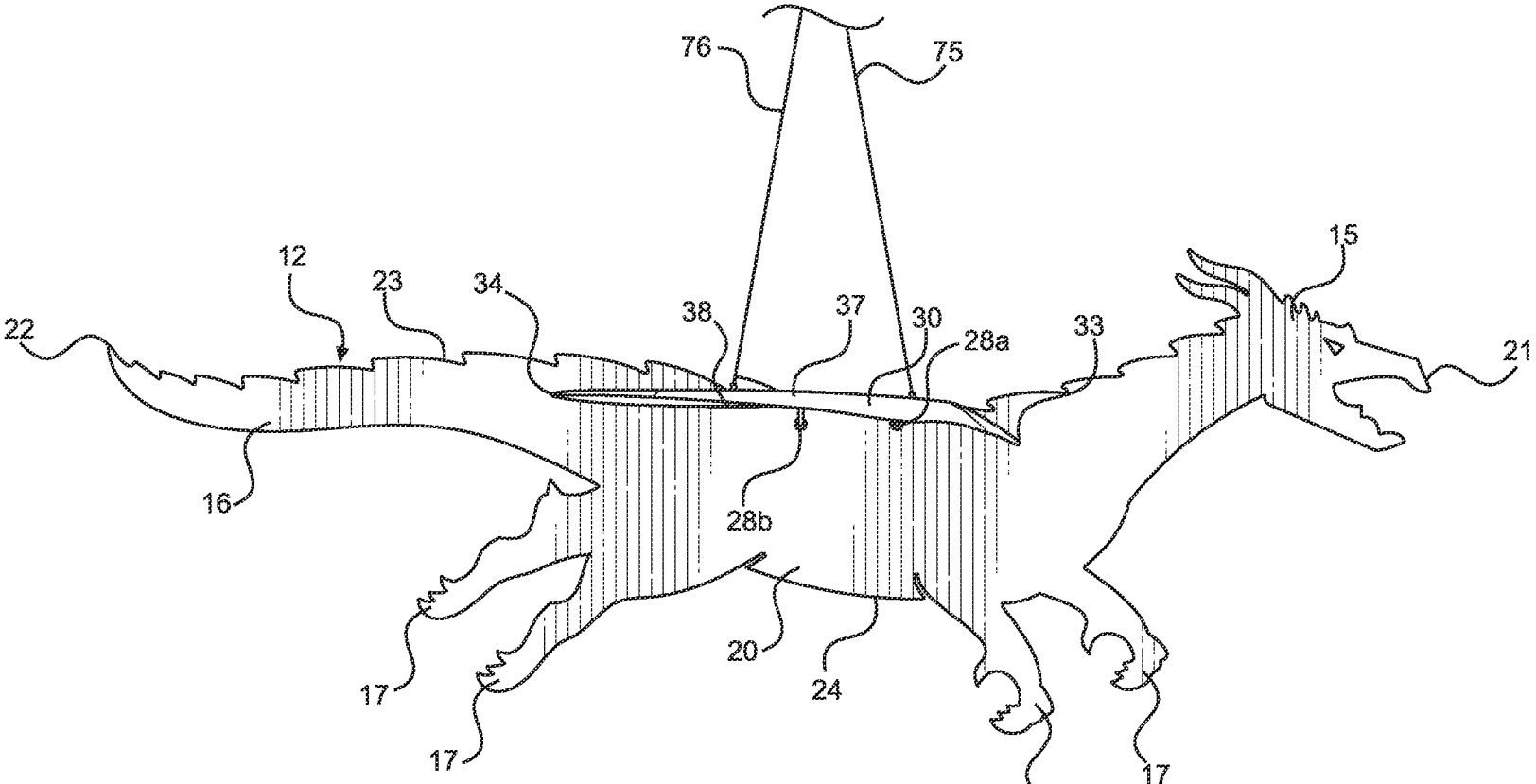
FIG. 7 is a side view of a kinetic sculpture in accordance with an example embodiment.

In the exemplary embodiment best shown in FIGS. 6 and 7, it can be seen that the front edge 33 of the first wing 30 is angled downwardly with respect to the rear edge 34 of the first wing 30. Thus, the front edge 33 of the first wing 30 is at a lower elevation than the rear edge 34 of the first wing 30. In this manner, air currents, such as driven by heat convection, will catch upon the front edge 33 of the first wing 30, causing the first wing 30 to pivotably move (i.e., flap) upwardly and downwardly in a repeating fashion.

Put differently, with respect to a straight line axis extending through the first wing 30 between its front and rear edges 33, 34, the front edge 33 of the first wing 30 will be below the axis, and the rear edge 34 of the first wing 30 will be above the axis. In this manner, the first wing 30 is angled downwardly between its rear edge 34 and its front edge 33 such as is best shown in FIGS. 6 and 7.

Figure 8:
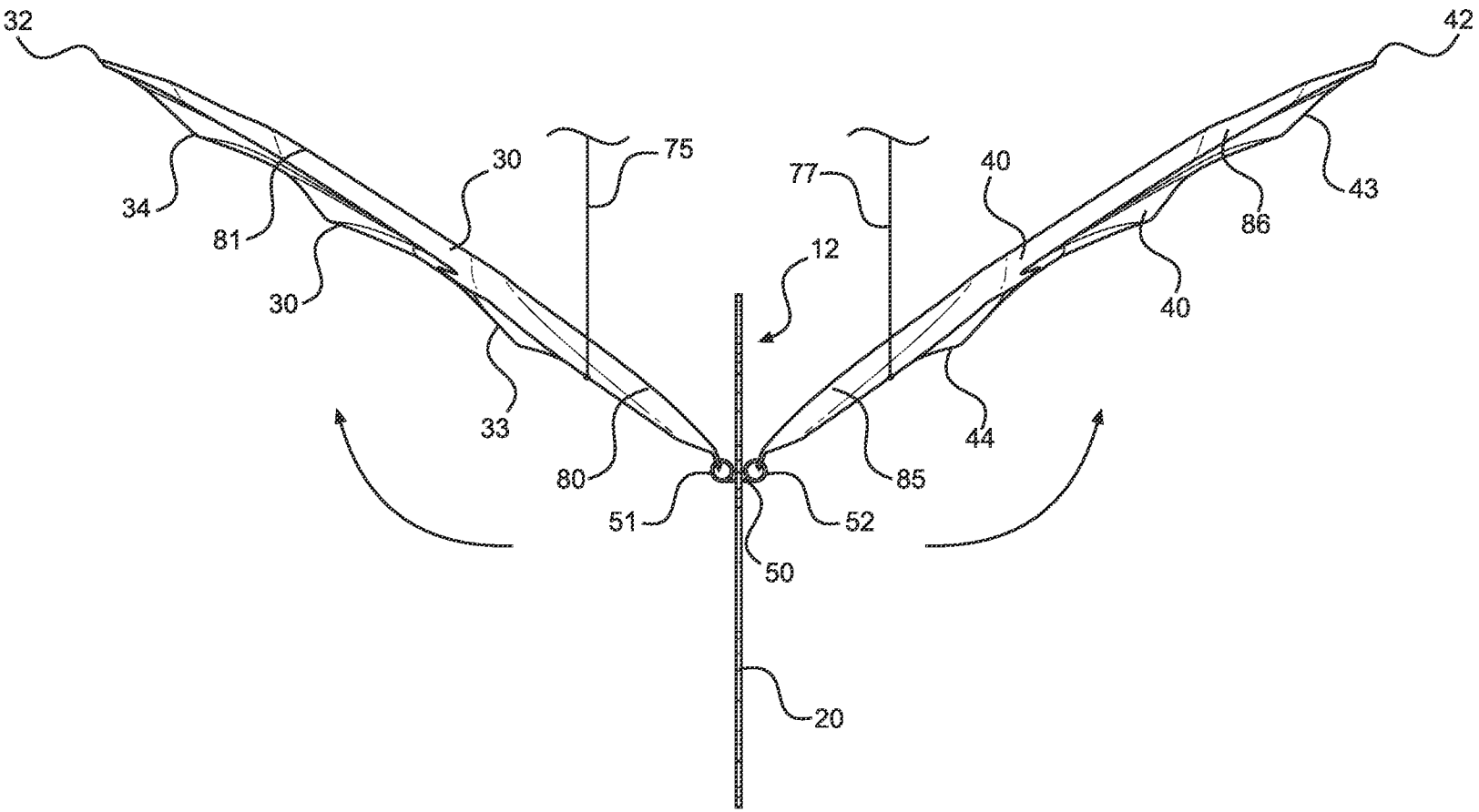
FIG. 8 is a frontal view of a kinetic sculpture with its wings in an upward position in accordance with an example embodiment.
Figure 9:
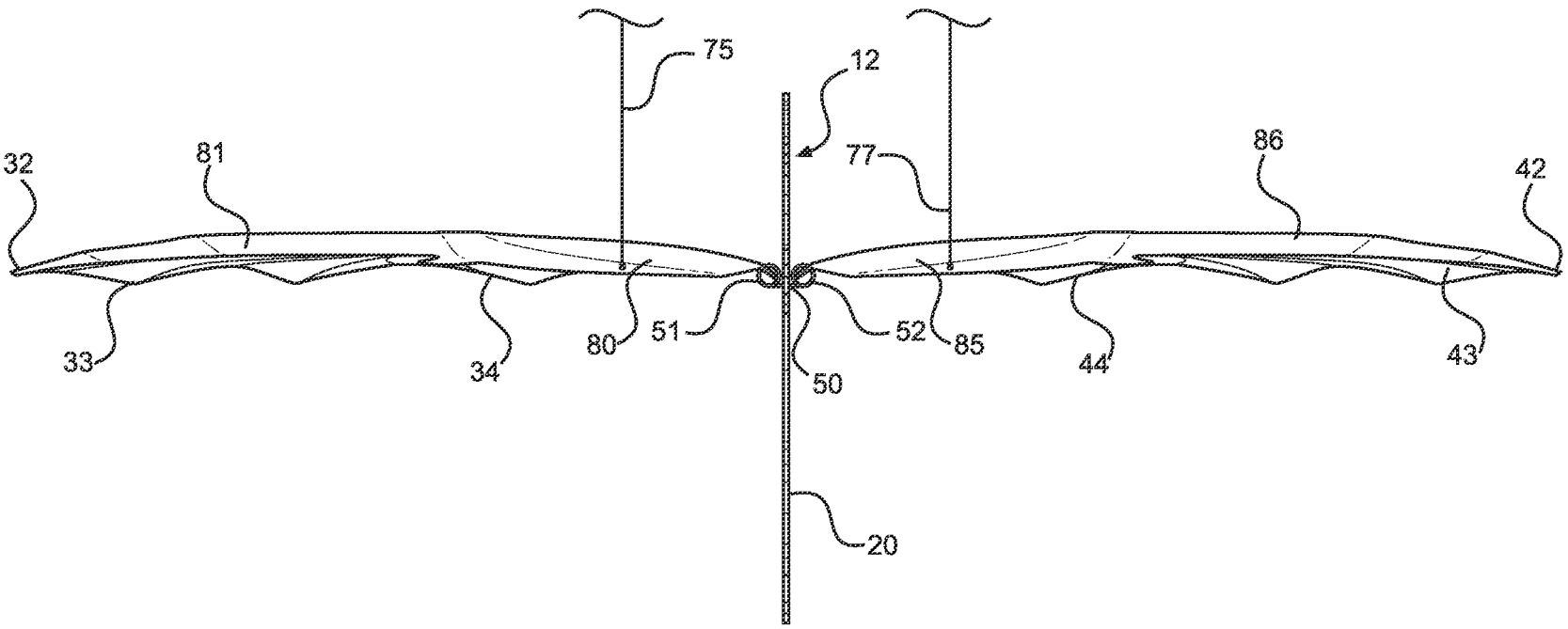
FIG. 9 is a frontal view of a kinetic sculpture with its wings in a centered position in accordance with an example embodiment.
Figure 10:
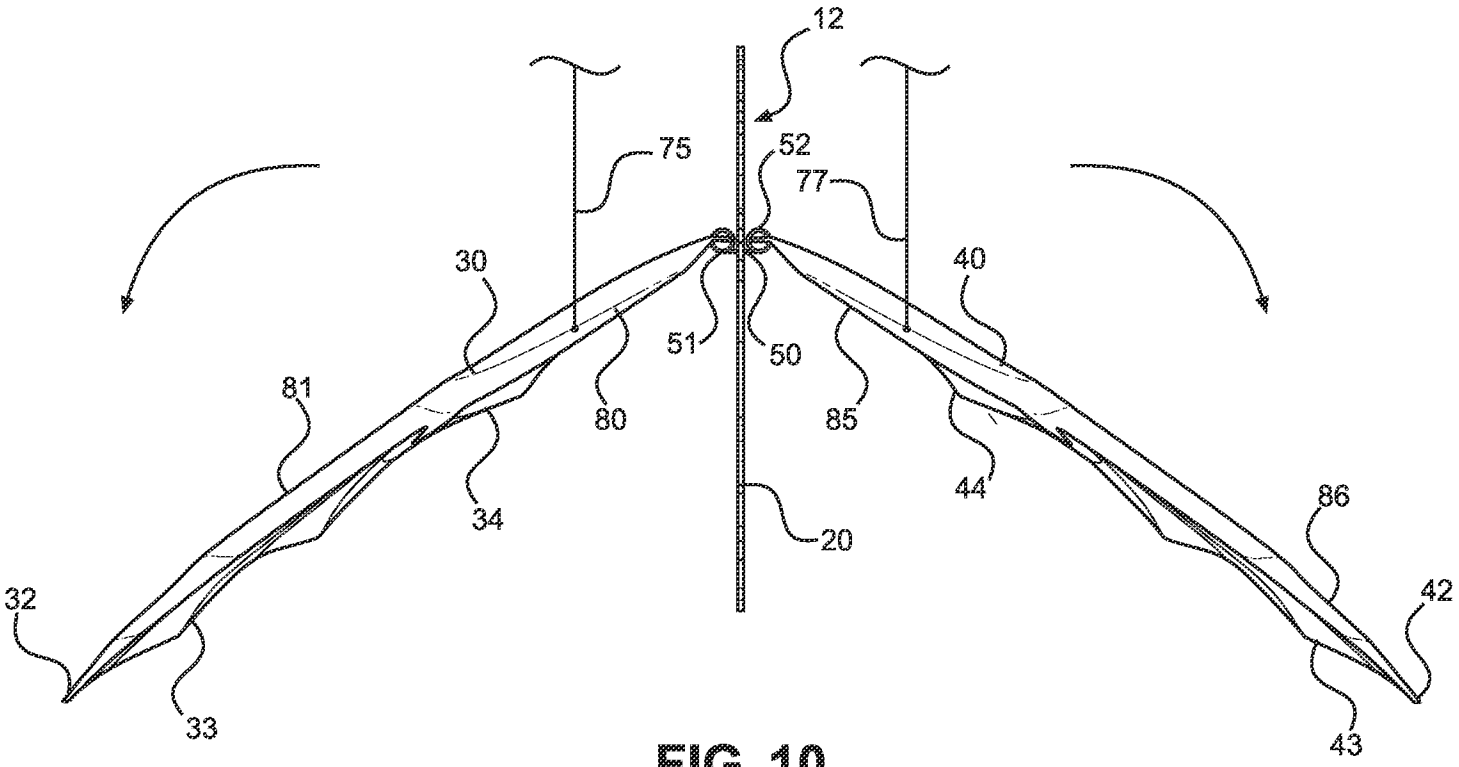
FIG. 10 is a frontal view of a kinetic sculpture with its wings in a lowered position in accordance with an example embodiment.

As best shown in FIGS. 8-10, the first wing 30 is pivotably attached to the main body 20. More specifically, in the embodiment shown in the figures, the first end 31 of the first wing 30 is pivotably attached to the first side 25 of the main body 20 such that the first wing 30 extends outwardly from the first side 25 of the main body 20. The manner in which the first wing 30 is pivotably attached to the main body 20 may vary in different embodiments. In the exemplary embodiment shown in the figures, the first wing 30 is shown as including a pair of body receivers 35*a*, 35*b* which are utilized to pivotably connect the first end 31 of the first wing 30 to the main body 20 of the kinetic sculpture 12.

As best shown in FIG. 5, the first wing 30 may include one or more body receivers 35*a*, 35*b* at or near the first end 31 of the first wing 30. In the exemplary embodiment shown in the figures, the first wing 30 includes a pair of body receivers 35*a*, 35*b*: a first body receiver 35*a* and a second body receiver 35*b*. Each of the body receivers 35*a*, 35*b* may comprise openings or other attachment points through which wing connectors 50, 55 may be utilized to pivotably connect the first wing 30 to the main body 20.

Continuing to reference FIG. 5, it can be seen that the first body receiver 35*a* of the first wing 30 may be positioned at or near the first end 31 of the first wing 30 at or near the front edge 33 of the first wing 30. Similarly, the second body receiver 35*b* of the first wing 30 may be positioned at or near the first end 31 of the first wing 30 at or near the rear edge 34 of the first wing 30. In this manner, both the front and rear edges 33, 34 of the first wing 30 are pivotably attached to the main body 20.

It should be appreciated that the positioning and number of body receivers 35*a*, 35*b* of the first wing 30 may vary in different embodiments. In some embodiments, a single body receiver 35*a*, 35*b* may be utilized, such as centrally between the front and rear edges 33, 34 of the first wing 30. In other embodiments, more than two body receivers 35*a*, 35*b* may be utilized. As a non-limiting example, a third body receiver (not shown) may be centrally positioned between the first body receiver 35*a* and the second body receiver 35*b*.

As shown in FIGS. 11-15, the first wing 30 is generally suspended, such as from a hanging structure 60, by one or more linkages 75, 76. The first wing 30 thus includes one or more hanging receivers 36*a*, 36*b* which act as attachment points for the linkages 75, 76. In the exemplary embodiment shown in FIG. 5, it can be seen that the first wing 30 includes a pair of hanging receivers 36*a*, 36*b* which may comprise openings within the first wing 30 to which a pair of connectors 70, 71 may be engaged to suspend the first wing 30 from the hanging structure 60.

Continuing to reference FIG. 5, it can be seen that each of the pair of hanging receivers 36*a*, 36*b* may comprise openings or other attachment points for the connectors 70, 71 to engage within. The number and positioning of hanging receivers 36*a*, 36*b* may vary in different embodiments. In the exemplary embodiment shown in FIG. 5, it can be seen that a first hanging receiver 36*a* is positioned near the front edge 33 of the first wing 30 and a second hanging receiver 36*b* is positioned near the rear edge 34 of the first wing 30. In some embodiments, the first and second hanging receivers 36*a*, 36*b* may be positioned elsewhere, such as further inwardly from the front and rear edges 33, 34 of the first wing 30. Further, in some embodiments, only a single hanging receiver 36*a*, 36*b* may be utilized, or additional (more than two) hanging receivers 36*a*, 36*b* may be utilized.

The positioning of the hanging receivers 36*a*, 36*b* with respect to the first and second ends 31, 32 of the first wing 30 may also vary. In the embodiments shown in the figures, the hanging receivers 36*a*, 36*b* are shown as being positioned approximately one quarter of the distance from the first end 31 to the second end 32 of the first wing 30. The positioning of the hanging receivers 36*a*, 36*b* could in alternate embodiments be closer to the second end 32 of the first wing 30, or centrally located between the first and second ends 31, 32 of the first wing 30.

The positioning of the hanging receivers 36*a*, 36*b* will generally depend upon the weight distribution of the first wing 30 and the main body 20, with the hanging receivers 36*a*, 36*b* being positioned so as to balance the weight between the outer portion 81 of the first wing 30 and the inner portion 80 of the first wing 30. Thus, in some embodiments, the inner portion 80 of the first wing 30 may be defined as the portion of the first wing 30 which is on a first side of the hanging receivers 36*a*, 36*b*, and the outer portion 81 of the first wing 30 may be defined as the portion of the first wing 30 which is on a second side of the hanging receivers 36*a*, 36*b*, with both portions 80, 81 being balanced in weight.

The orientation of the hanging receivers 36*a*, 36*b* of the first wing 30 may also vary in different embodiments. In the embodiment shown in the figures, the hanging receivers 36*a*, 36*b* are illustrated as being linearly-aligned such that the distance between the respective hanging receivers 36*a*, 36*b* and the first end 31 of the first wing 30 is equal. In some embodiments, one of the hanging receivers 36*a*, 36*b* may be instead closer to the first end 31 of the first wing 30 than the other hanging receiver 36*a*, 36*b* and thus not linearly-aligned.

As shown throughout the figures, the first wing 30 comprises an upper side 37 and a lower side 38. Generally, the linkages 75, 76 by which the first wing 30 is suspended will extend upwardly from the upper side 37 of the first wing 30 such as shown in FIG. 6. Each of the hanging receivers 36*a*, 36*b* may thus extend between the upper and lower sides 37, 38 of the first wing 30.

As shown throughout the figures, the first and second wings 30, 40 may be mirror images of each other. However, in some embodiments, the first and second wings 30, 40 may have different sizes or shapes. Thus, the scope should not be construed as limited by the exemplary embodiment in which it can be seen that the first and second wings 30, 40 are substantially the same size and shape.

a. Second Wing.

With reference to FIGS. 1-5, it can be seen that the second wing 40 generally comprises a first end 41 and a second end 42. The first end 41 of the second wing 40 is illustrated as being pivotably attached to the main body 20 of the kinetic sculpture 12. The positioning of the attachment point between the second wing 40 and the main body 20 may vary in different embodiments.

In the exemplary embodiment best shown in FIG. 1, it can be seen that the second wing 40 is pivotably attached near the upper end 23 of the main body 20 at the approximate mid-point between the front and rear ends 21, 22 of the main body 20. In some embodiments, the second wing 40 may instead be attached near the lower end 23 of the main body 20, or at any location between the upper and lower ends 23, 24 of the main body 20. Further, the second wing 40 may in some embodiments be attached closer to the front end 21 or the rear end 22 of the main body 20.

As shown in FIG. 4, the second wing 40 will generally comprise an inner portion 85 and an outer portion 86. The inner portion 85 may comprise the portion of the second wing 40 between the approximate mid-point of the second wing 40 between its first and second ends 41, 42 and the first end 41 of the second wing 40. The outer portion 86 may comprise the remaining portion of the second wing 40 between the approximate mid-point of the second wing 40 between its first and second ends 41, 42 and the second end 42 of the second wing 40. Thus, the inner portion 85 of the second wing 40 includes the first end 41 of the second wing 40 and the outer portion 86 of the second wing 40 includes the second end 42 of the second wing 40.

In some embodiments, the inner and outer portions 85, 86 of the second wing 40 may be defined by the attachment points of the linkages 77, 78 rather than being defined by the mid-point between the respective sides 41, 42 of the second wing 40. In such embodiments, the inner portion 85 of the second wing 40 is defined as the portion of the second wing 40 that is inset with respect to the attachment points of the linkages 77, 78 attached to the second wing 40 and the outer portion 86 of the second wing 40 is defined as the portion of the second wing 40 that is outset with respect to the attachment points of the linkages 77, 78 attached to the second wing 40.

Generally, the second wing 40 will be balanced such that the second wing 40 is adapted to catch an airflow such as an updraft to drive the main body 20 of the kinetic sculpture 12 in a forward or backward direction. Put differently, the second wing 40 is balanced so the weight on the outer portion 86 of the second wing 40 offsets the weight of the main body 20 and the inner portion 85 of the second wing 40. This can be accomplished in a number of manners. As an example, the inner portion 85 of the second wing 40 may comprise a first material and the outer portion 86 of the second wing 40 may comprise a second material, with the materials being selected based on their weights to balance the second wing 40.

As a further example, the respective weights of the inner and outer portions 85, 86 of the second wing 40 may be balanced by the thickness of the respective portions 85, 86 of the second wing 40. Thus, the thickness of the outer portion 86 of the second wing 40 may be greater than the thickness of the inner portion 85 of the second wing 40 such that the weight of the outer portion 86 is balanced with the weights of both the inner portion 85 of the second wing 40 and the main body 20. In yet other embodiments, weights or the like may be added to either the inner or outer portion 85, 86 of the second wing 40 to balance the inner and outer portions 85, 86.

As shown in FIGS. 4 and 5, the second wing 40 generally comprises a front edge 43 and a rear edge 44. The front edge 43 of the second wing 40 faces towards the forward direction along which the kinetic sculpture 12 is driven, such as by heat convection. The rear edge 44 of the second wing 40 faces away from the forward direction along which the kinetic sculpture 12 is driven.

In the exemplary embodiment best shown in FIGS. 6 and 7, it can be seen that the front edge 43 of the second wing 40 is angled downwardly with respect to the rear edge 44 of the second wing 40. Thus, the front edge 43 of the second wing 40 is at a lower elevation than the rear edge 44 of the second wing 40. In this manner, air currents, typically driven by heat convection, will catch upon the front edge 43 of the second wing 40, causing the second wing 40 to pivotably move (i.e., flap) upwardly and downwardly in a repeating fashion, thus driving the kinetic sculpture 12 in the forward direction.

Put differently, with respect to a straight line axis extending through the second wing 40 between its front and rear edges 43, 44, the front edge 43 of the second wing 40 will be below the axis, and the rear edge 44 of the second wing 40 will be above the axis. In this manner, the second wing 40 is angled downwardly between its rear edge 44 and its front edge 43 such as is best shown in FIGS. 6 and 7.

As best shown in FIGS. 8-10, the second wing 40 is pivotably attached to the main body 20. More specifically, in the embodiment shown in the figures, the first end 41 of the second wing 40 is pivotably attached to the second side 26 of the main body 20 such that the second wing 40 extends outwardly from the second side 26 of the main body 20. The manner in which the second wing 40 is pivotably attached to the main body 20 may vary in different embodiments. In the exemplary embodiment shown in the figures, the second wing 40 is shown as including a pair of body receivers 45*a*,

45*b* which are utilized to pivotably connect the first end 41 of the second wing 40 to the main body 20 of the kinetic sculpture 12.

As best shown in FIG. 5, the second wing 40 may include one or more body receivers 45*a*, 45*b* at or near the first end 41 of the second wing 40. In the exemplary embodiment shown in the figures, the second wing 40 includes a pair of body receivers 45*a*, 45*b*: a first body receiver 45*a* and a second body receiver 45*b*. Each of the body receivers 45*a*, 45*b* may comprise openings or other attachment points through which wing connectors 50, 55 may be utilized to pivotably connect the second wing 40 to the main body 20.

Continuing to reference FIG. 5, it can be seen that the first body receiver 45*a* of the second wing 40 may be positioned at or near the first end 41 of the second wing 40 at or near the front edge 43 of the second wing 40. Similarly, the second body receiver 45*b* of the second wing 40 may be positioned at or near the first end 41 of the second wing 40 at or near the rear edge 44 of the second wing 40. In this manner, both the front and rear edges 43, 44 of the second wing 40 are pivotably attached to the main body 20.

It should be appreciated that the positioning and number of body receivers 45*a*, 45*b* of the second wing 40 may vary in different embodiments. In some embodiments, a single body receiver 45*a*, 45*b* may be utilized, such as centrally between the front and rear edges 43, 44 of the second wing 40. In other embodiments, more than two body receivers 45*a*, 45*b* may be utilized. As a non-limiting example, a third body receiver (not shown) may be centrally positioned between the first body receiver 45*a* and the second body receiver 45*b*.

As shown in FIGS. 11-15, the second wing 40 is generally suspended, such as from a hanging structure 60, by one or more linkages 77, 78. The second wing 40 thus includes one or more hanging receivers 46*a*, 46*b* which act as attachment points for the linkages 77, 78. In the exemplary embodiment shown in FIG. 5, it can be seen that the second wing 40 includes a pair of hanging receivers 46*a*, 46*b* which may comprise openings within the second wing 40 to which a pair of connectors 72, 73 may be engaged to suspend the second wing 40 from the hanging structure 60.

Continuing to reference FIG. 5, it can be seen that each of the pair of hanging receivers 46*a*, 46*b* may comprise openings or other attachment points for the connectors 72, 73 to engage within. The number and positioning of hanging receivers 46*a*, 46*b* may vary in different embodiments. In the exemplary embodiment shown in FIG. 5, it can be seen that a first hanging receiver 46*a* is positioned near the front edge 43 of the second wing 40 and a second hanging receiver 46*b* is positioned near the rear edge 44 of the second wing 40. In some embodiments, the first and second hanging receivers 46*a*, 46*b* may be positioned elsewhere, such as further inwardly from the front and rear edges 43, 44 of the second wing 40. Further, in some embodiments, only a single hanging receiver 46*a*, 46*b* may be utilized, or additional (more than two) hanging receivers 46*a*, 46*b* may be utilized.

The positioning of the hanging receivers 46*a*, 46*b* with respect to the first and second ends 41, 42 of the second wing 40 may also vary. In the embodiments shown in the figures, the hanging receivers 46*a*, 46*b* are shown as being positioned approximately one quarter of the distance from the first end 41 to the second end 42 of the second wing 40. The positioning of the hanging receivers 46*a*, 46*b* could in alternate embodiments be closer to the second end 42 of the second wing 40, or centrally located between the first and second ends 41, 42 of the second wing 40.

The positioning of the hanging receivers 46*a*, 46*b* will generally depend upon the weight distribution of the second wing 40 and the main body 20, with the hanging receivers 46*a*, 46*b* being positioned so as to balance the weight between the outer portion 86 of the second wing 40 and the inner portion 85 of the second wing 40. Thus, in some embodiments, the inner portion 85 of the second wing 40 may be defined as the portion of the second wing 40 which is on a first side of the hanging receivers 46*a*, 46*b*, and the outer portion 86 of the second wing 40 may be defined as the portion of the second wing 40 which is on a second side of the hanging receivers 46*a*, 46*b*, with both portions 85, 86 being balanced in weight.

The orientation of the hanging receivers 46*a*, 46*b* of the second wing 40 may also vary in different embodiments. In the embodiment shown in the figures, the hanging receivers 46*a*, 46*b* are illustrated as being linearly-aligned such that the distance between the respective hanging receivers 46*a*, 46*b* and the first end 41 of the second wing 40 is equal. In some embodiments, one of the hanging receivers 46*a*, 46*b* may be instead closer to the first end 41 of the second wing 40 than the other hanging receiver 46*a*, 46*b* and thus not linearly-aligned.

As shown throughout the figures, the second wing 40 comprises an upper side 47 and a lower side 48. Generally, the linkages 77, 78 by which the second wing 40 is suspended will extend upwardly from the upper side 47 of the second wing 40 such as shown in FIG. 6. Each of the hanging receivers 46*a*, 46*b* may thus extend between the upper and lower sides 47, 48 of the second wing 40.

D. Wing Connectors.

As best shown in FIGS. 2-5, a pair of wing connectors 50, 55 may be utilized to pivotably connect the first and second wings 30, 40 to either side 25, 26 of the main body 20. Generally, a first wing connector 50 may comprise a first loop 51 and a second loop 52, with the first wing 30 being attached to the first loop 51 and the second wing 40 being attached to the second loop 52. Similarly, the second wing connector 55 may comprise a first loop 56 and a second loop 57, with the first wing 30 being attached to the first loop 56 and the second wing 40 being attached to the second loop 57.

In the embodiment shown in FIG. 5, it can be seen that each of the wings 30, 40 is attached to the main body 20 by a pair of wing connectors 50, 55. More specifically, it can be seen that the first wing 30 is attached at its first end 31 to the main body 20 by a first wing connector 50 positioned near the front edge 33 of the first wing 30 and a second wing connector 55 positioned near the rear edge 34 of the first wing 30. Similarly, it can be seen that the second wing 40 is attached at its first end 41 to the main body 20 by the first wing connector 50 positioned near the front edge 43 of the second wing 40 and the second wing connector 55 positioned near the rear edge 44 of the second wing.

As best shown in FIGS. 8-10, the first wing 30 is pivotably attached at or near its first end 31 to the first loop 51 of the first wing connector 50 and to the first loop 56 of the second wing connector 55. Similarly, the second wing 40 is pivotably attached at or near its first end 41 to the second loop 52 of the first wing connector 50 and to the second loop 57 of the second wing connector 55.

This embodiment functions to secure both the front and rear edges 33, 34, 43, 44 of each wing 30, 40 to the main body 20. However, it should be appreciated that more or less wing connectors 50, 55 may be utilized. For example, a single wing connector 50, 55 could be positioned centrally between the front and rear edges 33, 34, 43, 44 of each wing 30, 40. As a further example, additional wing connectors 50, 55 could be positioned between the first and second wing connectors 50, 55 for added stability in some embodiments.

As shown in FIGS. 4 and 5, the first wing connector 50 will generally comprise a first loop 51 and a second loop 52. The first wing connector 50 is attached to the main body 20 by extending through the first opening 28*a* of the main body 20, with the first loop 51 being positioned on a first side 25 of the main body 20 to connect to the first wing 30 and the second loop 52 being positioned on a second side 26 of the main body 20 to connect to the second wing 40.

As shown in FIGS. 4 and 5, the second wing connector 55 will also generally comprise a first loop 56 and a second loop 57. The second wing connector 55 is attached to the main body 20 by extending through the second opening 28*b* of the main body 20, with the first loop 56 being positioned on a first side 25 of the main body 20 to connect to the first wing 30 and the second loop 57 being positioned on a second side 26 of the main body 20 to connect to the second wing 40.

Generally, each wing connector 50, 55 will comprise a length of wire or other type of thin elongated member which has been curled up at either end to form a pair of loops 51, 52, 56, 57. The central linkage between the pair of loops 51, 52, 56, 57 of each wing connector 50, 55 thus extends through the openings 28*a*, 28*b* of the main body 20 such as shown in FIG. 8.

It should be appreciated, however, that the size, positioning, orientation, shape, and configuration of the wing connectors 50, 55 may vary in different embodiments and thus should not be construed as limited by the exemplary figures. In some embodiments, the wing connectors 50, 55 may comprise hinge devices which allow for the pivotable attachment between the wings 30, 40 and the main body 20. In other embodiments, each wing 30, 40 may be directly attached to the main body 20 without the need for discrete wing connectors 50, 55.

E. Hanging Structure and Stand.

As best shown in FIGS. 11-15, the kinetic sculpture system 10 will generally include a hanging structure 60 from which one or more kinetic sculptures 12 may be suspended. It should be appreciated that, while the figures illustrate embodiments utilizing a pair of kinetic sculptures 12, 12', some embodiments may utilize additional kinetic sculptures 12, 12'. Thus, the scope should not be construed as limited to one or a pair of kinetic sculptures 12, 12', as the hanging structure 60 may in some embodiments support additional kinetic sculptures 12, 12'.

Figure 11:
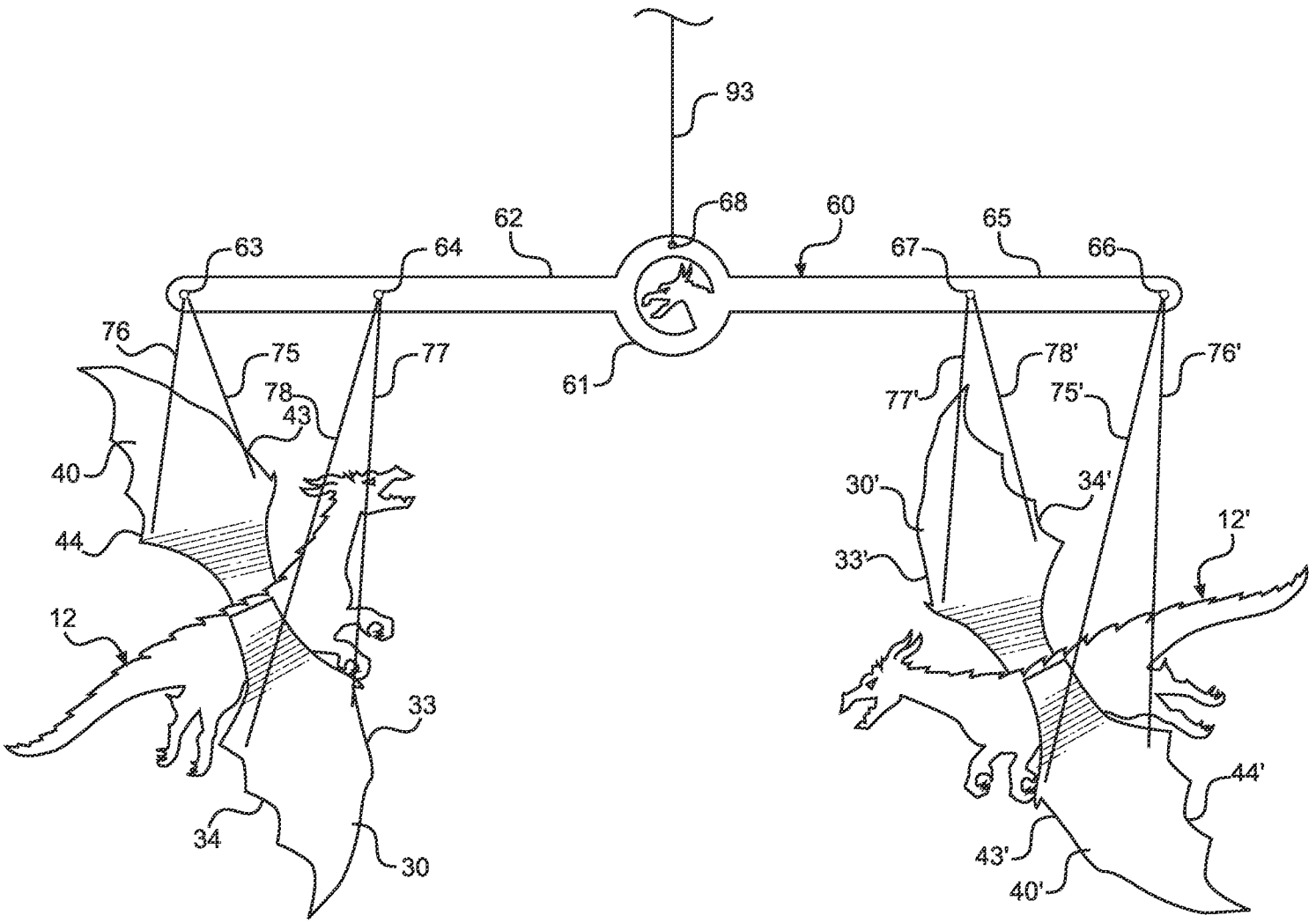
FIG. 11 is a perspective view of a kinetic sculpture system including a pair of kinetic sculptures suspended from a hanging structure in accordance with an example embodiment.

As best shown in FIG. 11, the hanging structure 60 may comprise an elongated member such as a rod, shaft, bar, pole, post, or the like from which the kinetic sculpture 12 may be suspended over a heat source 19 such that a convection airflow from the heat source 19 drives the kinetic sculpture 12 in a forward or backward direction. In the exemplary embodiment shown in the figures, the hanging structure 60 is illustrated as comprising a central portion 61 from which a pair of elongated members 62, 65 extends linearly outward in opposite directions.

As shown in FIG. 11, the hanging structure 60 includes a first elongated member 62 extending in a first direction from the central portion 61 and a second elongated member 65 extending in a second, opposite direction from the central portion 61. It should be appreciated that the central portion 61, first elongated member 62, and second elongated member 65 may be integrally formed of a unitary structure in some embodiments. In other embodiments, the central portion 61, first elongated member 62, and second elongated member 65 may comprise discrete, interconnected structures.

Continuing to reference FIG. 11, it can be seen that a first kinetic sculpture 12 may be suspended from the first elongated member 62 of the hanging structure 60 and a second kinetic sculpture 12' may be suspended from the second elongated member 65 of the hanging structure 60. As previously discussed, additional kinetic sculptures 12 may be included in some embodiments, and thus the exemplary embodiment shown in the figures utilizing a pair of kinetic sculptures 12, 12' should not be construed as limiting in scope.

The hanging structure 60 is generally configured to be balanced by the weight of the pair of kinetic sculptures 12, 12' such as shown in FIG. 11. Thus, in the embodiment shown in the figures in which the pair of kinetic sculptures 12, 12' are identical, each kinetic sculpture 12, 12' is positioned an equidistance away from the central portion 61 of the hanging structure 60. However, in some embodiments in which the pair of kinetic sculptures 12, 12' are not identical, the positioning of the kinetic sculptures 12, 12' may be adjusted to ensure that the hanging structure 60 is balanced (i.e., such that, with the pair of kinetic sculptures 12, 12' attached, the hanging structure 60 remains substantially horizontal rather than being weighed down on either side).

As best shown in FIG. 11, the first elongated member 62 of the hanging structure 60 may include a pair of receivers 63, 64. An outer receiver 63 is positioned at or near the distal end of the first elongated member 62 and an inset receiver 64 is positioned at a point inset from the outer receiver 63. The distance between the outer and inset receivers 63, 64 of the first elongated member 62 may vary depending upon the weight distribution of the kinetic sculpture 12, and thus should not be construed as limited by the exemplary figures.

Similarly, as shown in FIG. 11, the second elongated member 65 of the hanging structure 60 may include a pair of receivers 66, 67. An outer receiver 66 is positioned at or near the distal end of the second elongated member 65 and an inset receiver 67 is positioned at point inset from the outer receiver 66. The distance between the outer and inset receivers 66, 67 of the second elongated member 65 may vary depending upon the weight distribution of the kinetic sculpture 12, and thus should not be construed as limited by the exemplary figures.

With reference to FIG. 11, it can be seen that each of the receivers 63, 64, 66, 67 may comprise an opening in the respective elongated members 62, 65 in which linkages 75, 76, 77, 78 may be secured. In the exemplary embodiment shown in FIG. 11, it can be seen that a first outer linkage 75 and a second outer linkage 76 are attached to the outer receiver 63 of the first elongated member 62. In some embodiments, the first and second outer linkages 75, 76 may comprise a single string, cord, rope, wire, chain, or the like which extends through the outer receiver 63 of the first elongated member 62 and is bifurcated. In other embodiments, the first outer linkage 75 may comprise a first string, cord, rope, wire, chain, or the like and the second outer linkage 76 may comprise a second string, cord, rope, wire, chain, or the like.

Generally, the first outer linkage 75 and the second outer linkage 76 each extend downwardly from the hanging structure 60 to be attached to the first wing 30. In the embodiment best shown in FIGS. 4 and 11, it can be seen that the distal end of the first outer linkage 75 includes a first outer connector 70 which engages within the first hanging receiver 36*a* of the first wing 30 and that the distal end of the second outer linkage 76 includes a second outer connector 72 which engages within the second hanging receiver 36*b* of the first wing 30. The outer connectors 70, 72 may comprise various connecting structures, such as but not limited to clamps, brackets, plugs, anchors, hooks, loops, fasteners, adhesives, and the like.

In the exemplary embodiment shown in FIG. 11, it can be seen that a first inset linkage 77 and a second inset linkage 78 are attached to the inset receiver 64 of the first elongated member 62. In some embodiments, the first and second inset linkages 77, 78 may comprise a single string, cord, rope, wire, chain, or the like which extends through the inset receiver 64 of the first elongated member 62 and is bifurcated. In other embodiments, the first inset linkage 77 may comprise a first string, cord, rope, wire, chain, or the like and the second inset linkage 78 may comprise a second string, cord, rope, wire, chain, or the like.

Generally, the first inset linkage 77 and the second inset linkage 78 each extend downwardly from the hanging structure 60 to be attached to the second wing 40. In the embodiment best shown in FIG. 4, it can be seen that the distal end of the first inset linkage 77 includes a first inset connector 71 which engages within the first hanging receiver 46*a* of the second wing 40 and that the distal end of the second inset linkage 78 includes a second inset connector 73 which engages within the second hanging receiver 46*b* of the second wing 40. The inset connectors 71, 73 may comprise various connecting structures, such as but not limited to clamps, brackets, plugs, anchors, hooks, loops, fasteners, adhesives, and the like.

As shown in FIG. 11, in embodiments in which a second kinetic sculpture 12' is suspended from the second elongated member 65, additional linkages 75', 76', 77', 78' may be attached to the first and second wings 30', 40' of the second kinetic sculpture 12' in the same manner as was previously described.

FIG. 11 also illustrates that the orientation of the kinetic sculptures 12, 12' may be reversed in certain embodiments. In the embodiment shown in FIG. 11, the linkages 75, 76 may be attached to the second wing 40, the linkages 77, 78 may be attached to the first wing 30, the linkages 75', 76' may be attached to the second wing 40', and the linkages 77', 78' may be attached to the first wing 30'.

Figure 12:
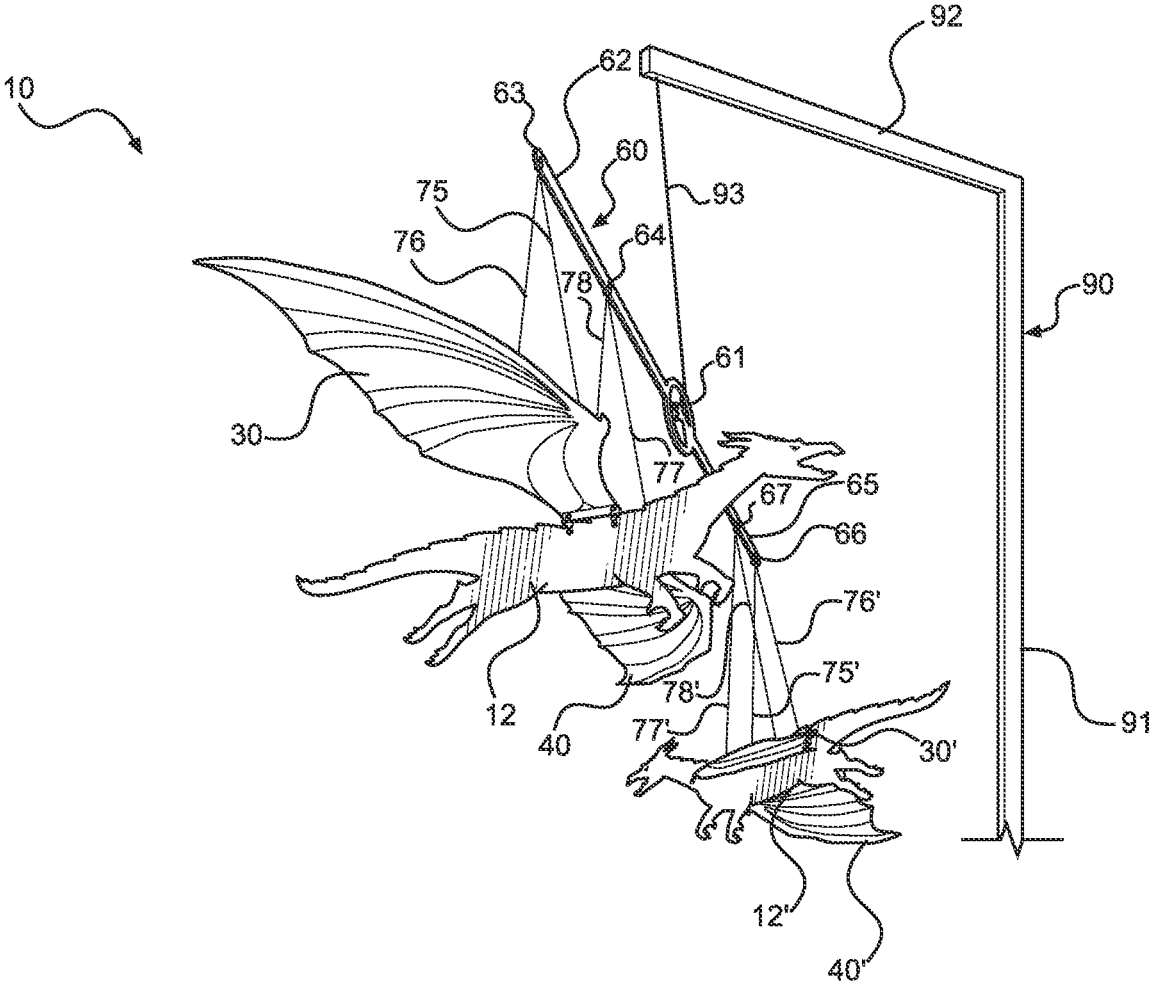
FIG. 12 is a perspective view of a kinetic sculpture system including a pair of kinetic sculptures suspended over an updraft source in a first position in accordance with an example embodiment.
Figure 12:
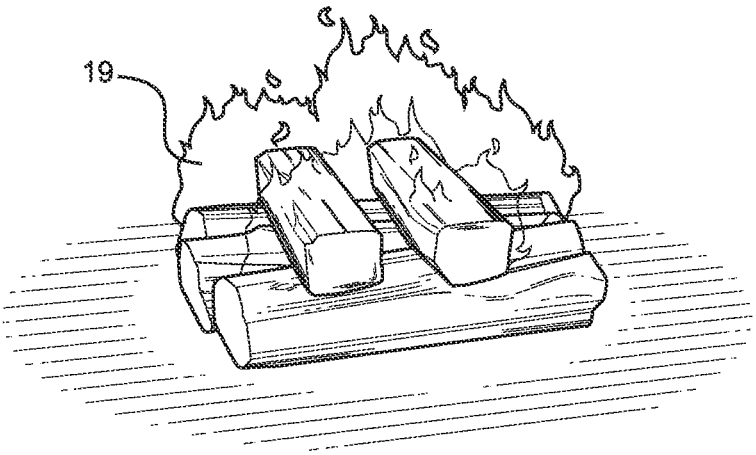
Figure 13:
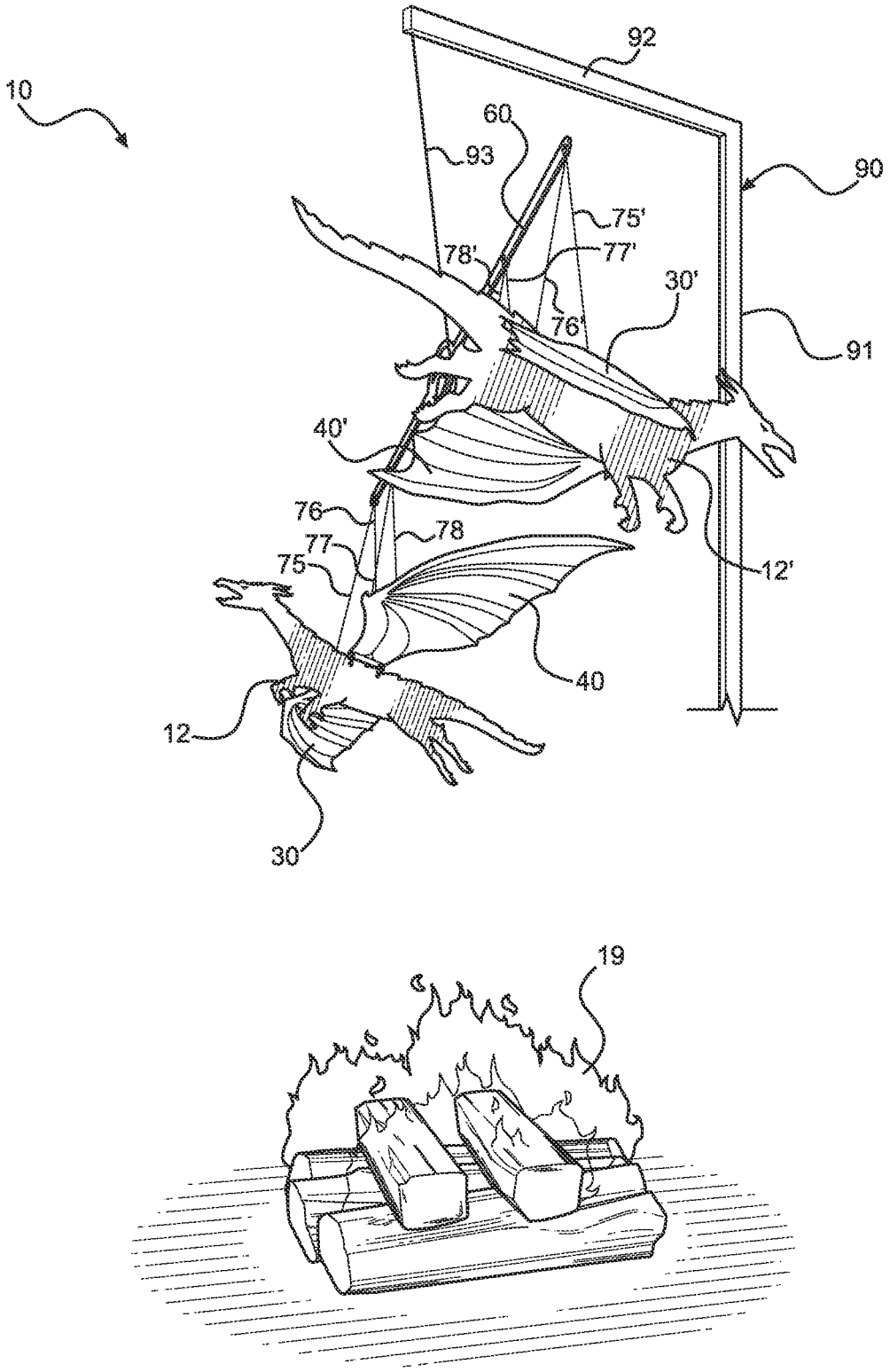
FIG. 13 is a perspective view of a kinetic sculpture system including a pair of kinetic sculptures suspended over an updraft source in a second position in accordance with an example embodiment.

In the embodiment shown in FIGS. 12 and 13, the reverse orientation is utilized. In such an embodiment, the linkages 75, 76 may be attached to the first wing 30, the linkages 77, 78 may be attached to the second wing 40, the linkages 75', 76' may be attached to the first wing 30', and the linkages 77', 78' may be attached to the second wing 40'. It should thus be appreciated that the orientation by which the kinetic sculptures 12, 12' are attached to the hanging structure 60 by the linkages 75, 76, 77, 78, 75', 76', 77', 78' may vary in different embodiments.

The hanging structure 60 will generally be positioned over an updraft source, such as but not limited to a heat source 19 which provides an updraft caused by convection from the heat source 19 that catches upon the front edges 33, 43 of the respective wings 30, 40 to drive the kinetic sculpture 12 in a forward direction. The manner in which the hanging structure 60 is positioned over the heat source 19 may vary in different embodiments. In an exemplary embodiment, a stand 90 may be utilized.

As shown in FIGS. 12 and 13, the stand 90 may comprise a vertical member 91 which is driven into or anchored to a ground surface. A horizontal member 92 extends perpendicularly with respect to the vertical member 91, though other angles may be utilized in some embodiments. Further, although the figures illustrate that the horizontal member 92 extends from the upper distal end of the vertical member 91, it should be appreciated that the horizontal member 92 in some embodiments may extend instead from different points along the height of the vertical member 91.

Continuing to reference FIGS. 12 and 13, it can be seen that a stand linkage 93 extends from the horizontal member 92 of the stand 90, with the hanging structure 60 being suspended from the stand 90 by the stand linkage 93. The stand linkage 93 may comprise a string, cord, rope, wire, chain, or the like. The stand linkage 93 will generally be attached to the hanging structure 60 at a central point thereof, such as to the central portion 61 of the hanging structure 60 such that the hanging structure 60 is balanced. As shown in FIG. 11, the central portion 61 of the hanging structure 60 may include a central receiver 68 comprised of an opening to which the stand linkage 93 may be connected. In some embodiments, the stand linkage 93 may be connected to the central portion 61 of the hanging structure 60 by other methods, such as clamps, brackets, and the like, without need of a central receiver 68.

In another exemplary embodiment, the central portion 61 of the hanging structure 60 may comprise an inverted cup shape. In such an embodiment, the stand 90 may consist of only a vertical member 91 (e.g., without including a horizontal member 92), with the central portion 61 of the hanging structure 60, comprised of an inverted cup shape, being balanced on the upper end (e.g., a distal point) of the stand 90. In such an embodiment, the stand 90 may be positioned within or directly above an updraft source such as a heat source 19 (e.g., in the center of a fire or directly above a blower or fan).

F. Operation of Preferred Embodiment.

In use, the kinetic sculpture 12 is first suspended over a heat source 19. The manner in which the kinetic sculpture 12 is suspended over the heat source 19 may vary in different embodiments. In some embodiments, the kinetic sculpture 12 may be suspended by a single linkage which extends downwardly from an overhanging structure such as a tree branch, ceiling, tent, or other type of structure overhanging the heat source 19. In such an embodiment, the single linkage may be attached to the main body 20 of the kinetic sculpture 12.

In an embodiment such as shown in the figures, the kinetic sculpture 12 may be suspended from a hanging structure 60. In such an embodiment, one or more linkages 75, 76, 77, 78 extend downwardly from the hanging structure 60, with the kinetic sculpture 12 being attached to the one or more linkages 75, 76, 77, 78. In an embodiment such as shown in FIG. 11, it can be seen that a first pair of linkages 75, 76 may be attached to the second wing 40 and that a second pair of linkages 77, 78 may be attached to the first wing 30. However, the orientation of the kinetic sculpture 12 may vary in different embodiments. In the embodiment shown in FIGS. 11 and 12, the kinetic sculptures 12 are reversed in orientation, with the first pair of linkages 75, 76 instead being attached to the first wing 30 and the second pair of linkages 77, 78 instead being attached to the second wing 40.

More specifically, the first wing 30 of the kinetic sculpture 12 may be attached to and suspended from the hanging structure 60 by a first outer linkage 75 and a second outer linkage 76 with each of the outer linkages 75, 76 being attached to an outer receiver 63 of the hanging structure 60. The second wing 40 of the kinetic sculpture 12 may be attached to and suspended from the hanging structure 60 by a first inset linkage 77 and a second inset linkage 78 with each of the inset linkages 77, 78 being attached to an inset receiver 64 of the hanging structure 60.

In some embodiments such as shown in FIGS. 11-15, multiple kinetic sculptures 12, 12' may be attached to and suspended from a single hanging structure 60. In such an embodiment, the first kinetic sculpture 12 may be suspended from a first elongated member 62 of the hanging structure 60 and the second kinetic sculpture 12' may be suspended from a second elongated member 65 of the hanging structure 60. As previously discussed, the number of linkages 75, 76, 77, 78, 75', 76', 77', 78' utilized to suspend each kinetic sculpture 12, 12' from the hanging structure 60 may vary in different embodiments. Further, the positioning of the linkages 75, 76, 77, 78, 75', 76', 77', 78' may also vary in different embodiments.

With reference to FIGS. 11-15, it can be seen that a first kinetic sculpture 12 is attached to and suspended from the hanging structure 60 by a pair of outer linkages 75, 76 and a pair of inset linkages 77, 78 attached to the outer and inset receivers 63, 64 of the first elongated member 62 by a plurality of linkages 75, 76, 77, 78. In such an embodiment, first and second outer linkages 75, 76 are attached between the outer receiver 63 of the first elongated member 62 and the first wing 30, and first and second inset linkages 77, 78 are attached between the inset receiver 64 of the first elongated member 62 and the second wing 40 of the first kinetic sculpture 12.

Continuing to reference FIGS. 11-15, it can be seen that a second kinetic sculpture 12' is attached to and suspended from the hanging structure 60 by a pair of outer linkages 75', 76' and a pair of inset linkages 77', 78' attached to the outer and inset receivers 66, 67 of the second elongated member 65 by a plurality of linkages 75', 76', 77', 78'. In such an embodiment, first and second outer linkages 75', 76', are attached between the outer receiver 66 of the second elongated member 65 and the first wing 30', and first and second inset linkages 77', 78', are attached between the inset receiver 67 of the second elongated member 65 and the second wing 40' of the second kinetic sculpture 12'.

The manner in which the hanging structure 60 is itself positioned over a heat source 19 may vary in different embodiments. The hanging structure 60 may simply be secured to or suspended from an overhanging structure such as a tree branch, ceiling, tent, or other structure positioned above the heat source 19. In the embodiment shown in FIGS. 11-13, a stand 90 including a vertical member 91 and a horizontal member 92 may be utilized, with the vertical member 91 being secured to the ground surface and the hanging structure 60 being suspended from the distal end of the horizontal member 92 by a hanging linkage 93.

As shown in FIGS. 12-15, one or more kinetic sculptures 12, 12' are suspended over a heat source 19. The type of heat source 19 utilized may vary in different embodiments. The figures illustrate a heat source 19 comprised of a camp fire. However, heat sources 19 may comprise various other types of flames, such as but not limited to a candle or fire pit. Further, in some embodiments, the heat source 19 may not be a fire, but instead comprised of an electrical or gas heating device such as but not limited to various types of heaters or lights.

The heat source 19 will generally be positioned on the ground surface underlying the kinetic sculptures 12, 12', but in some embodiments may be raised with respect to the ground surface (such as, for example, when the heat source 19 comprises a raised fire pit). The kinetic sculptures 12, 12' are generally positioned over the heat source 19, such as by being suspended over the heat source 19.

Figure 14:
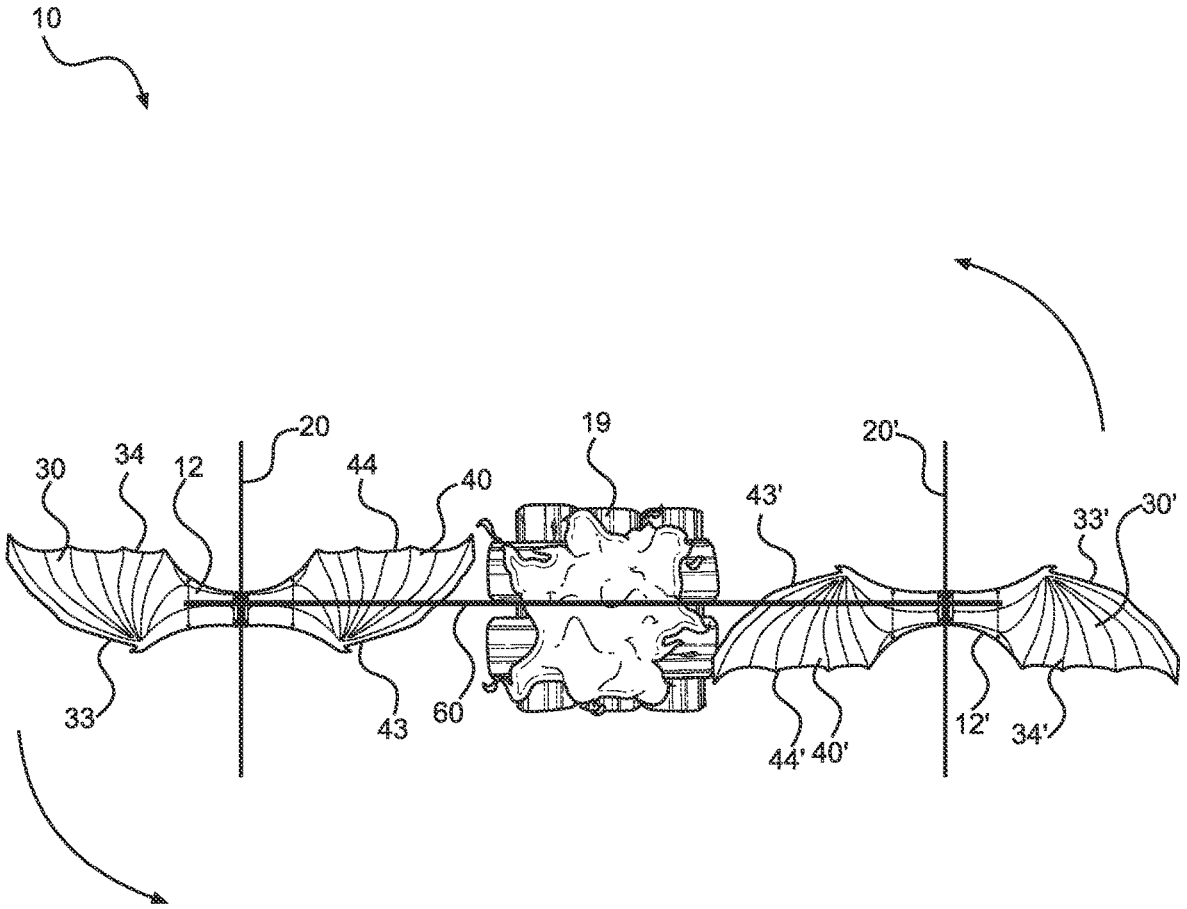
FIG. 14 is a top view of a kinetic sculpture system including a pair of kinetic sculptures suspended over an updraft source in a first position in accordance with an example embodiment.
Figure 15:
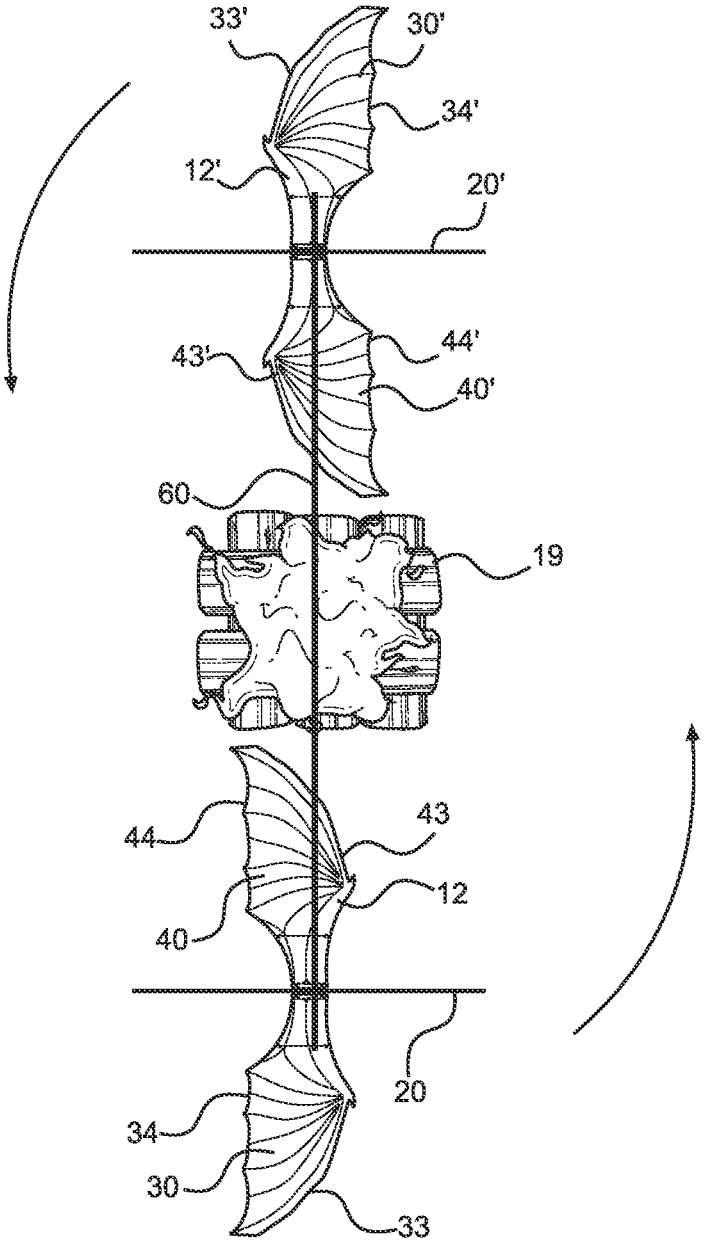
FIG. 15 is a top view of a kinetic sculpture system including a pair of kinetic sculptures suspended over an updraft source in a second position in accordance with an example embodiment.

With reference to FIGS. 12-15, it can be seen that a pair of kinetic sculptures 12, 12' are positioned over the heat source 19. Heat from the heat source 19 causes a convection air current updraft which circulates and rises from the heat source 19. This updraft current impacts the lower sides 38, 48 of the respective wings 30, 40 of the kinetic sculpture 12. The updraft current then catches upon the front edges 33, 43 of the respective wings 30, 40, which causes the wings 30, 40 to flap upwardly and downwardly with respect to the main body 20. In this manner, each kinetic sculpture 12 is driven in a forward direction around a looped path such as shown in FIGS. 14 and 15, giving the appearance that each kinetic sculpture 12 is flying around the heat source 19.

Unless otherwise defined, all technical and scientific terms used herein have the same meaning as commonly understood by one of ordinary skill in the art to which this invention belongs. Although methods and materials similar to or equivalent to those described herein can be used in the practice or testing of the kinetic sculpture system, suitable methods and materials are described above. All publications, patent applications, patents, and other references mentioned herein are incorporated by reference in their entirety to the extent allowed by applicable law and regulations. The kinetic sculpture system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A kinetic device, comprising:

a main body comprising a first side and a second side;

a first wing pivotably attached to the main body, wherein the first wing extends outwardly from the first side of the main body; and a second wing pivotably attached to the main body, wherein the second wing extends outwardly from the second side of the main body;

wherein the first wing comprises a first front edge and a first rear edge, wherein the first wing is angled downwardly from the first rear edge to the first front edge;

wherein the second wing comprises a second front edge and a second rear edge, wherein the second wing is angled downwardly from the second rear edge to the second front edge;

wherein the first front edge of the first wing and the second front edge of the second wing are each adapted to catch an updraft such that the first wing and the second wing drive the main body in a forward direction.

2. The kinetic device of claim 1, wherein the first wing comprises a first inner portion and a first outer portion, wherein the first outer portion is weight balanced with the first inner portion and the main body.

3. The kinetic device of claim 2, wherein the first outer portion of the first wing weighs more than the first inner portion of the first wing.

4. The kinetic device of claim 2, wherein the first outer portion of the first wing is comprised of a first material, wherein the first inner portion of the first wing is comprised of a second material, and wherein the first material weighs more than the second material.

5. The kinetic device of claim 2, wherein the second wing comprises a second inner portion and a second outer portion, wherein the second outer portion is weight balanced with the second inner portion and the main body.

6. The kinetic device of claim 5, wherein the second outer portion of the second wing is comprised of a first material, wherein the second inner portion of the second wing is comprised of a second material, and wherein the first material weighs more than the second material.

7. The kinetic device of claim 1, wherein the first front edge of the first wing is lower than the first rear edge of the first wing and wherein the second front edge of the second wing is lower than the second rear edge of the second wing.

8. The kinetic device of claim 1, further comprising a first connector attached to the main body, wherein the first wing and the second wing are each pivotably attached to the first connector.

9. The kinetic device of claim 8, wherein the first connector comprises a first loop positioned on the first side of the main body and a second loop positioned on the second side of the main body, wherein the first wing is pivotably attached to the first loop, and wherein the second wing is pivotably attached to the second loop.

10. The kinetic device of claim 8, further comprising a second connector attached to the main body, wherein the first wing and the second wing are each pivotably attached to the second connector.

11. The kinetic device of claim 10, wherein the second connector comprises a first loop positioned on the first side of the main body and a second loop positioned on the second side of the main body, wherein the first wing is pivotably attached to the first loop, and wherein the second wing is pivotably attached to the second loop.

12. The kinetic device of claim 1, wherein the main body is comprised of a dragon shape.

13. The kinetic device of claim 1, further comprising a first linkage attached to the first wing and a second linkage attached to the second wing.

14. The kinetic device of claim 13, wherein the first linkage and the second linkage are each comprised of a string.

15. A kinetic sculpture system, comprising:

a hanging structure positioned over an updraft source;

a first kinetic sculpture suspended from the hanging structure, wherein the first kinetic sculpture is comprised of a first main body, and a first pair of wings pivotably attached to the first main body, wherein each of the first pair of wings comprises a first front edge which is angled downwardly with respect to a first rear edge; and a second kinetic sculpture suspended from the hanging structure, wherein the second kinetic sculpture is comprised of a second main body, and a second pair of wings pivotably attached to the second main body, wherein each of the second pair of wings comprises a second front edge which is angled downwardly with respect to a second rear edge;

wherein an updraft from the updraft source is adapted to impact a lower end of each of the first and second pairs of wings to drive the first and second kinetic sculptures forward along a looped path.

16. The kinetic sculpture system of claim 15, wherein the updraft source is comprised of a fire.

17. The kinetic sculpture system of claim 15, wherein the hanging structure is comprised of a central portion, a first elongated member extending in a first direction from the central portion, and a second elongated member extending in a second, opposite direction from the central portion.

18. The kinetic sculpture system of claim 17, wherein the first kinetic sculpture is suspended from the first elongated member and wherein the second kinetic sculpture is suspended from the second elongated member.

19. The kinetic sculpture system of claim 17, further comprising a stand including a vertical member and a horizontal member, wherein the vertical member is anchored to a ground surface, wherein the horizontal member is positioned over the updraft source, and wherein the hanging structure is suspended from the horizontal member.

20. The kinetic sculpture system of claim 15, wherein the first kinetic sculpture is comprised of a dragon shape.

* * * * *